US009453311B2

(12) United States Patent
Braniff et al.

(10) Patent No.: US 9,453,311 B2
(45) Date of Patent: Sep. 27, 2016

(54) ACCESS GATE AND ASSOCIATED SYSTEMS, APPARATUS, AND METHODS

(71) Applicant: INTERNATIONAL SPEEDWAY CORPORATION, Daytona Beach, FL (US)

(72) Inventors: William James Braniff, Daytona Beach, FL (US); Jack E. Swinford, Munford, AL (US); Gregory L. Buckner, Plant City, FL (US)

(73) Assignee: INTERNATIONAL SPEEDWAY CORPORATION, Daytona Beach, FL (US)

( * ) Notice: Subject to any disclaimer, the term of this patent is extended or adjusted under 35 U.S.C. 154(b) by 178 days.

(21) Appl. No.: 14/313,275

(22) Filed: Jun. 24, 2014

(65) Prior Publication Data

US 2015/0368971 A1 Dec. 24, 2015

(51) Int. Cl.

| | |
|---|---|
| ***E06B 11/02*** | (2006.01) |
| ***E01F 13/04*** | (2006.01) |
| ***E01F 15/08*** | (2006.01) |
| ***E01F 15/12*** | (2006.01) |
| ***E06B 5/01*** | (2006.01) |
| *E06B 3/40* | (2006.01) |

(52) U.S. Cl.

CPC ..... *E01F 13/04* (2013.01); *E01F 15/08* (2013.01); *E01F 15/12* (2013.01); *E06B 5/01* (2013.01); *E06B 11/022* (2013.01); *E06B 11/02* (2013.01); *E06B 2003/403* (2013.01)

(58) Field of Classification Search

None

See application file for complete search history.

(56) References Cited

U.S. PATENT DOCUMENTS

| | | | | |
|---|---|---|---|---|
| 217,762 | A * | 7/1879 | Witte | E05C 17/443 292/338 |
| 1,149,623 | A * | 8/1915 | Bramley | A63K 1/00 256/13.1 |
| 1,647,836 | A * | 11/1927 | Lyons | E06B 5/01 49/33 |
| 2,121,766 | A * | 6/1938 | Wicks | E05C 17/50 16/86 A |
| 2,452,461 | A * | 10/1948 | Harris | E05C 17/50 16/86 A |
| 3,724,527 | A * | 4/1973 | Johns | E06B 11/02 160/368.1 |
| 4,159,837 | A * | 7/1979 | Morita | E05C 17/50 16/85 |
| 4,811,454 | A * | 3/1989 | Crook | E05C 17/00 16/82 |
| 6,904,643 | B2 * | 6/2005 | Duffy | E05F 3/108 16/82 |
| 6,926,461 | B1 | 8/2005 | Faller et al. | |
| 7,410,320 | B2 | 8/2008 | Faller et al. | |
| 8,647,012 | B2 * | 2/2014 | Wilkinson | E01F 15/12 256/13.1 |
| 2005/0071950 | A1 * | 4/2005 | Nantais | E05F 5/06 16/85 |
| 2013/0056998 | A1 * | 3/2013 | Chincarini, Jr. | E05C 17/36 292/262 |

* cited by examiner

*Primary Examiner* — Matthieu Setliff

(74) *Attorney, Agent, or Firm* — Alston & Bird LLP

(57) ABSTRACT

An access gate provides access to cross a wall and may comprise at least one hinged wall portion configured to be moved between an open and a closed position. In the closed position, the hinged wall portion acts as a barrier between a first and a second side of the wall. In the open position, the hinged wall portion allows passage between the first and second sides of the wall. The access gate may comprise a crossing surface to allow passage between the first and second sides of the wall; and at least one hinged surface door configured to be moved between a closed and an open position. In the closed position, the surface door prevents access to the crossing surface and provides a walkable/drivable surface. In the open position, the surface door provides access to the crossing surface.

14 Claims, 18 Drawing Sheets

ACCESS GATE AND ASSOCIATED SYSTEMS, APPARATUS, AND METHODS

TECHNOLOGICAL FIELD

The present invention relates generally to providing access through a gate. Example embodiments of the present invention particularly relate to providing pedestrian access through a gate for crossing over and/or through a wall and/or a fence that is configured to act as a protective barrier.

BACKGROUND

In various situations it may be advantageous to provide access for pedestrians to cross a wall and/or fence. In some situations, the wall and/or fence may be a protective barrier, and therefore may have specific structural requirements. In some situations, a wall may separate two areas having different elevations (e.g., the ground on one side of the wall may be higher than on the other side of the wall). For example, a wall and catch fence around a race track may provide a protective barrier for spectators watching a race from debris from an incident occurring on the race track. Additionally, the stands around the race track may be at higher elevation than the race track to provide spectators with a better view of the race. It may be desired to allow spectators to cross the wall from the stands to the race track for pre- or post-race activities and prevent spectators from gaining access to the race track during the race. Such access gates may be referred to as crossover gates, such as where the pedestrians climb over the wall through an opening in a catch fence, for example, using stairs and/or a ladder. The size and structure of certain existing access gates may limit the number and rate of pedestrians that may cross the wall during a given time period, may present additional safety hazards and difficulty of operation and use, and/or may compromise the integrity of the protective barrier provided by the wall and/or fence.

A number of deficiencies and problems associated with providing access to cross a wall and/or fence are identified herein. Through applied effort, ingenuity, and innovation, exemplary solutions to many of these identified problems are embodied by the present invention, which is described in detail below.

BRIEF SUMMARY

Systems, apparatuses, and methods are therefore provided according to example embodiments of the present invention to provide pedestrian, vehicular, and/or other access for crossing a wall and/or fence. Some example embodiments provide pedestrian access for crossing through a wall and fence that is configured to act as a protective barrier, such as a wall and catch fence of a race track, possibly with different elevations on the race track and stand area on the opposite side of the wall and fence from the race track.

In one embodiment, an access gate configured for allowing access to cross a wall is provided. The access gate may comprise at least one hinged wall portion configured to be moved between an open position and a closed position. When the hinged wall portion is in the closed position, the hinged wall portion is configured to act as a barrier between the a first side of the wall and a second side of the wall and, when the hinged wall portion is in the open position, the hinged wall portion is configured to allow passage between the first of the wall and the second side of the wall. The access gate may further comprise a crossing surface to allow passage between the first side of the wall and the second side of the wall. The hinged wall portion is located at a first end of the crossing surface. The access gate may also comprise at least one hinged surface door configured to be moved between a closed position and an open position. When the hinged surface door is in the closed position, the hinged surface door is configured to prevent access to the crossing surface and to provide a walkable and/or drivable surface and, when the hinged surface door is in the open position, the hinged surface door is configured to provide access to a second end of the crossing surface.

In various embodiments, the hinged wall portion is configured to be moved between the open position and the closed position by a winch. In some embodiments, at least one pneumatic piston is connected to the at least one hinged surface door. The at least one pneumatic piston is configured to assist movement of the hinged surface door between the closed and open positions. In various embodiments, the access gate may further comprise at least one lock block configured to be positioned below a lower edge of the at least one hinged surface door when the hinged surface door is in the open position and configured to prevent the hinged surface door from moving to the closed position. In some embodiments, the access gate may further comprise at least one door support configured to be positioned between the crossing surface and the at least one hinged surface door when the hinged surface door is in the closed position and configured to support the hinged surface door in horizontal position to provide the walkable and/or drivable surface. In various embodiments, the wall may comprise at least one normal wall portion, at least one hinge panel, at least one latch panel, and the at least one hinged wall portion. The hinged wall portion may be hingedly connected to the hinge panel and the hinged wall portion may be configured to rest against at least a portion of the latch panel when the hinged wall portion is in the closed position. In some embodiments, the access gate may further comprise a permanent catch fence located above the at least one hinged wall portion; and a foldable catch fence located below the permanent catch fence and above at least a portion of the at least one hinged wall portion. The foldable catch fence may be configured to be folded into a retracted, elevated position to provide additional head room when the hinged wall portion is in the open position and the foldable catch fence may be configured to be secured into an unfolded position when the hinged wall portion is I the closed position to act as a barrier between the first side and the second side of the wall. In various embodiments, the access gate may further comprise at least one hinge pin and at least one latch pin. The at least one hinge pin may be configured to pass through at least a portion of the hinged wall portion and the hinge panel. The at least one latch pin may be configured to pass through at least a portion of the hinged wall portion and the latch panel when the hinged wall portion is in the closed position. In some embodiments, the at least hinge pin and the at least one latch pin extend into corresponding pin holes in the crossing surface. In various embodiments the at least one hinge pin acts as the pin in a hinge when the hinged wall portion is moved between the open and closed positions. In some embodiments, the access gate may further comprise at least one of a locking hook and a gate cable. The locking hook and the gate cable may be configured, when engaged when the hinged wall portion is in the open position, to prevent the hinged wall portion from moving between the open position and closed position. In some embodiments, the at least one hinged surface door comprises two hinged surface doors. At least a first one of the two hinged surface doors may comprise an overlap portion and, when the two hinged surface doors are in the closed position, the overlap portion of the first hinged surface door being configured to overlap a portion of the second hinged surface door. In various embodiments, the at least one hinged surface door may comprise two hinged surface doors and the access gate may further comprise at least one door support configured to be positioned between the crossing surface and the two hinged surface doors when the hinged surface doors are in the closed position and wherein at least a portion of each of the two hinged surface doors rests on the at least one door support. In some embodiments, the wall is around a race track and may be configured to act as a barrier between pedestrians watching a race and the race track, and the access gate is a pedestrian and/or vehicle access gate. In various embodiments, the access gate may further comprise a handrail. The handrail may have at least one support post configured to rest in at least one support post hole located in the crossing surface, when the hinged surface door is in the open position.

In one embodiment, a method for providing access across a wall is provided. The method may comprise rotating at least one hinged surface door from a closed position to an open position to provide access to a first end of a crossing surface; driving a winch to rotate a hinged wall portion located at a second end of the crossing surface from a closed position to an open position; securing the hinged wall portion in the open position; and securing a foldable catch fence portion in a folded up position to allow head room for passing through the gate.

In various embodiments, the method may further comprise, before driving the winch to rotate the hinged wall portion, removing at least one latch pin configured to pass through at least a portion of the hinged wall portion and a latch panel of the wall and to hold the hinged wall portion in the closed position; and removing all but one hinge pin of one or more gate pins configured to pass through at least a portion of the hinged wall portion and a hinge panel of the wall. In some embodiments, the method may further comprise securing the at least one hinged surface door in the open position by wedging a lock block beneath a lower edge off the at least one hinged surface door. In various embodiments, the method may further comprise, after rotating the at least one hinged surface door to the open position and before driving the winch to rotate the hinged wall portion into the open position, removing a door support configured to support the at least one hinged surface door when the at least one hinged surface door is in the closed position. In some embodiments, driving the winch to rotate the hinged wall portion may comprise providing approximately five foot-pounds or more of torque to drive the winch.

In one embodiment, method for operating a gate is provided. The method may comprise opening at least one surface door from a closed position to an open position to provide access to a first end of a recessed crossing surface; removing one or more gate pins from a latch portion of a wall securing a hinged wall portion in a closed position at a second end of the recessed crossing surface; and rotating the hinged wall portion from the closed position with the wall to an open position allowing passage across the recessed crossing surface through the wall. The hinged wall portion may rotate on a gate pin configured to operate as a hinge pin to permit rotation of the hinged wall portion about a hinge panel of the wall on the hinge pin.

In various embodiments, the method may further comprise removing one or more gate pins, but not the hinge pin, from the hinged wall portion and the hinge panel of the wall.

BRIEF DESCRIPTION OF THE DRAWINGS

Figure 1:
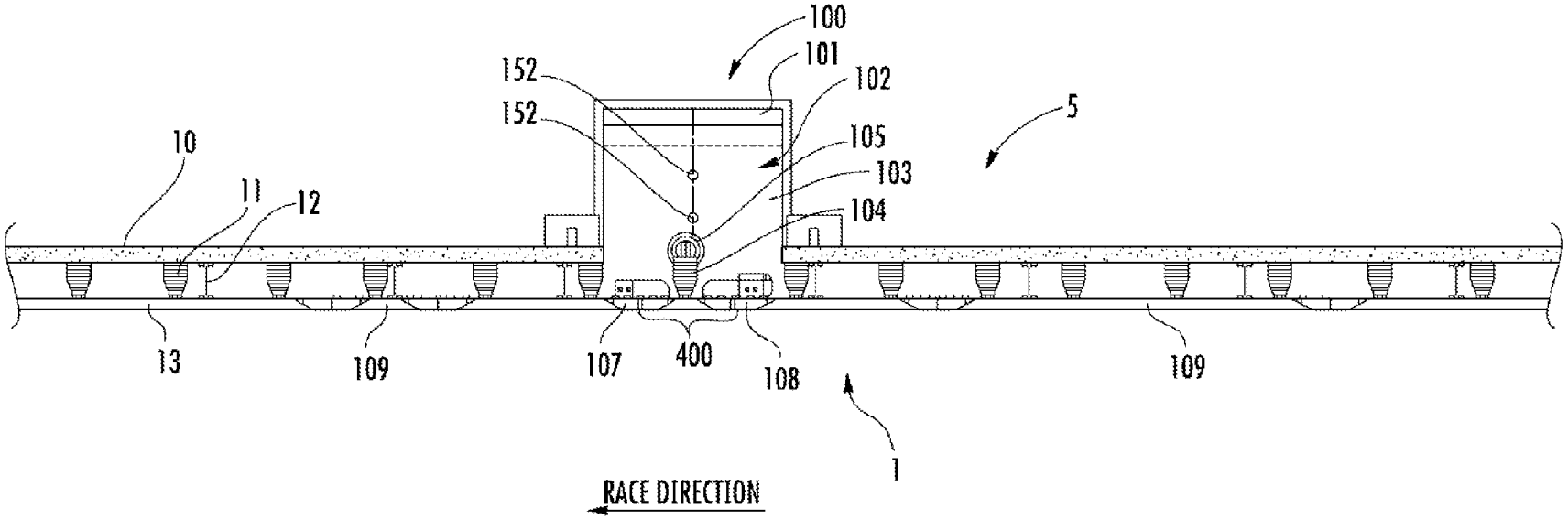
Figure 2:
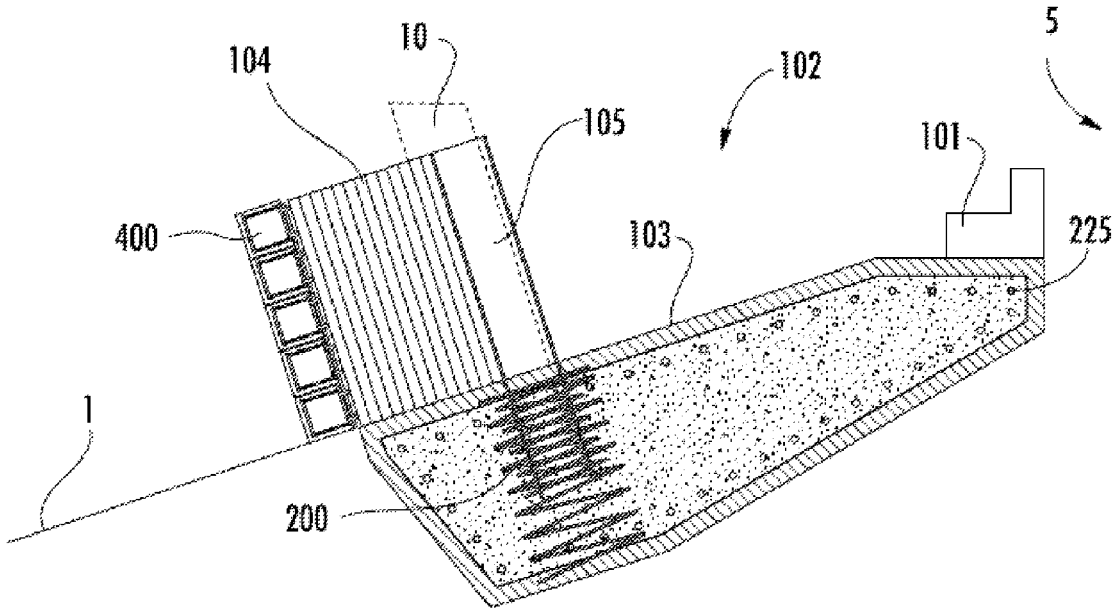
Figure 3:
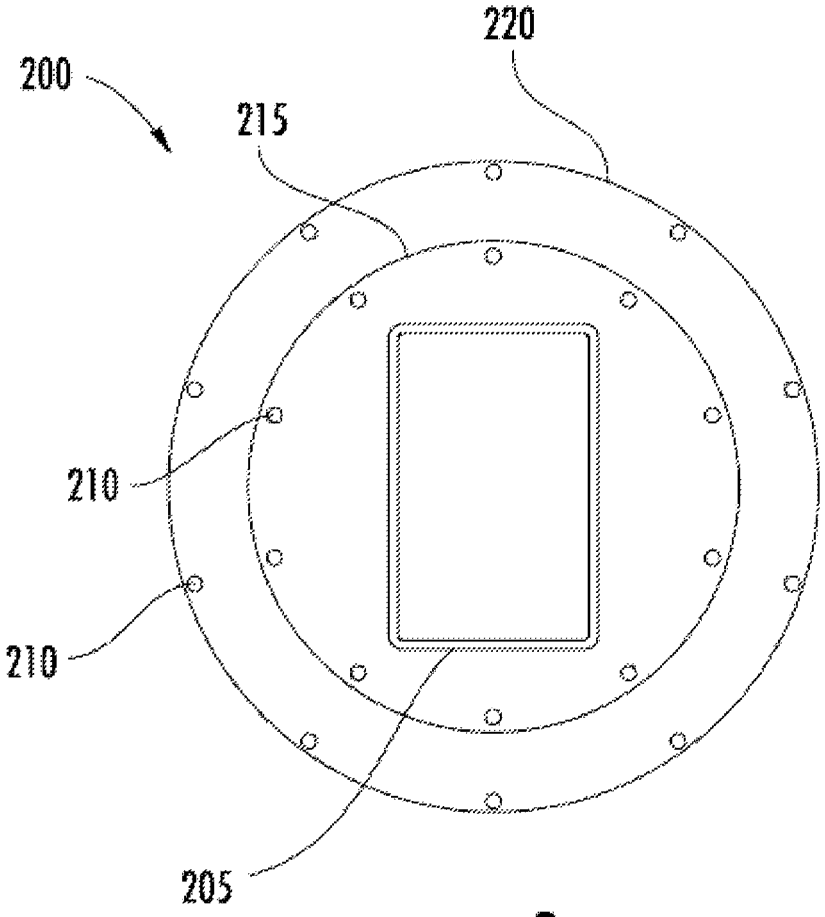
Figure 4:
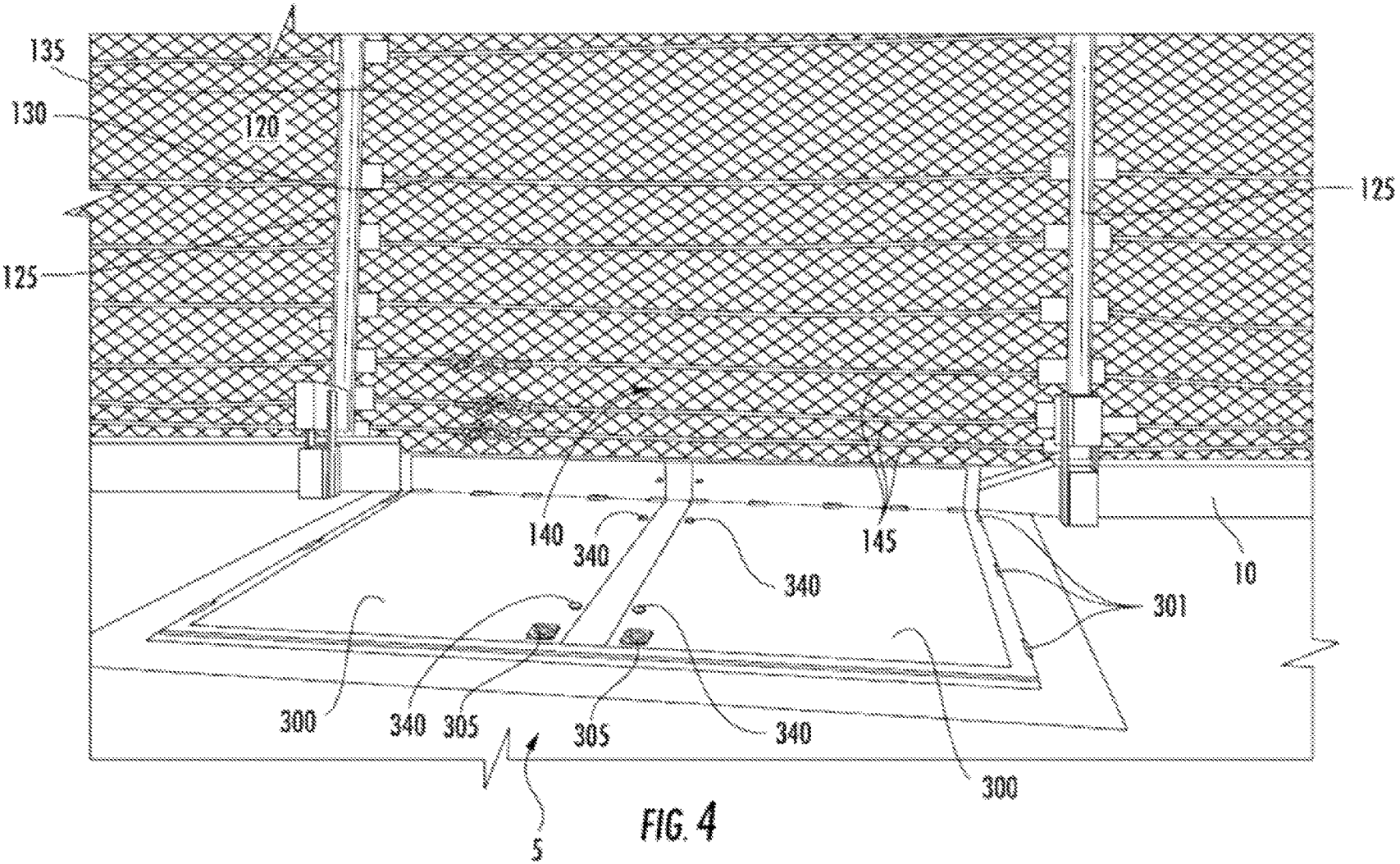
Figure 5:
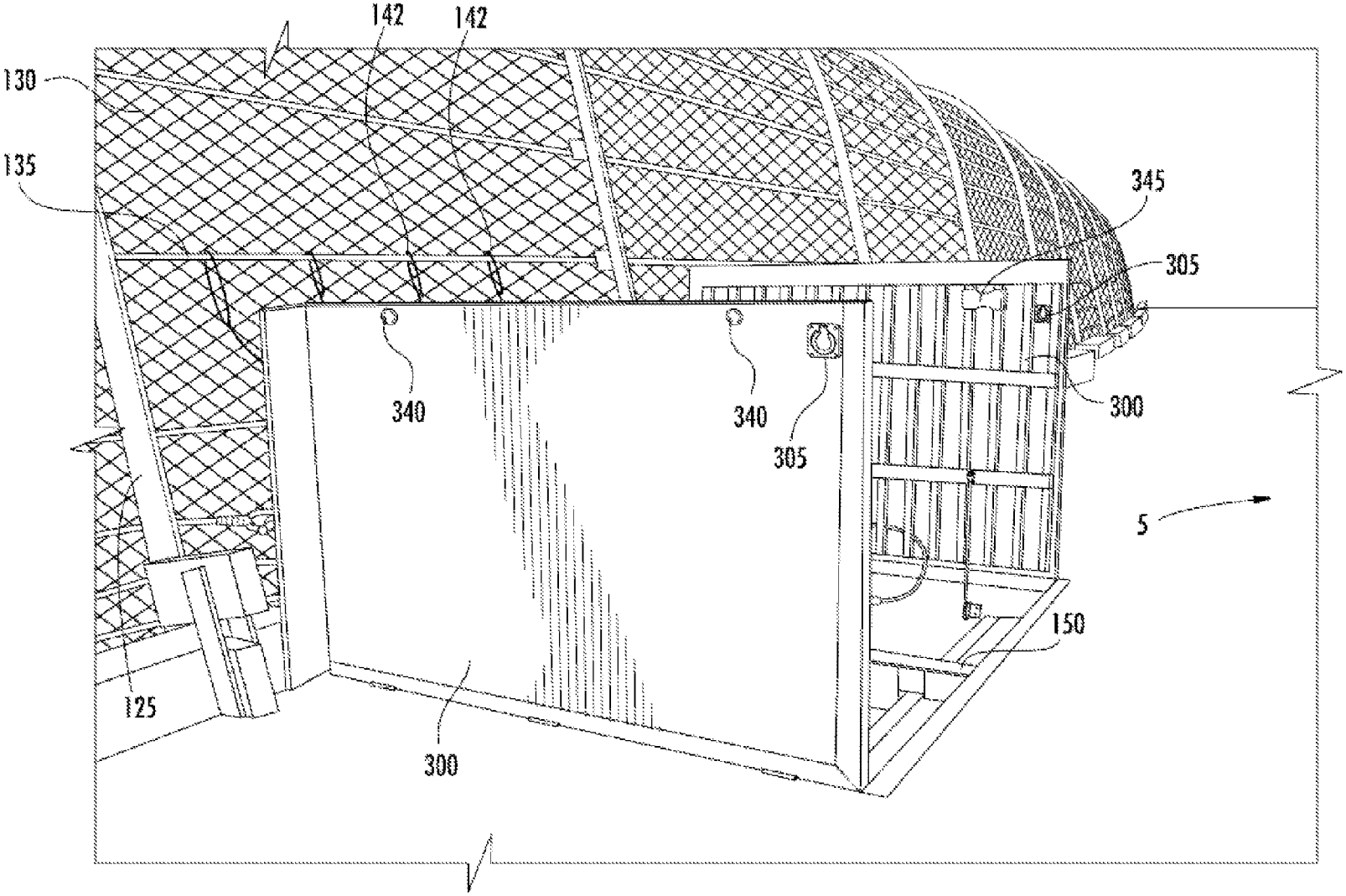
Figure 6:
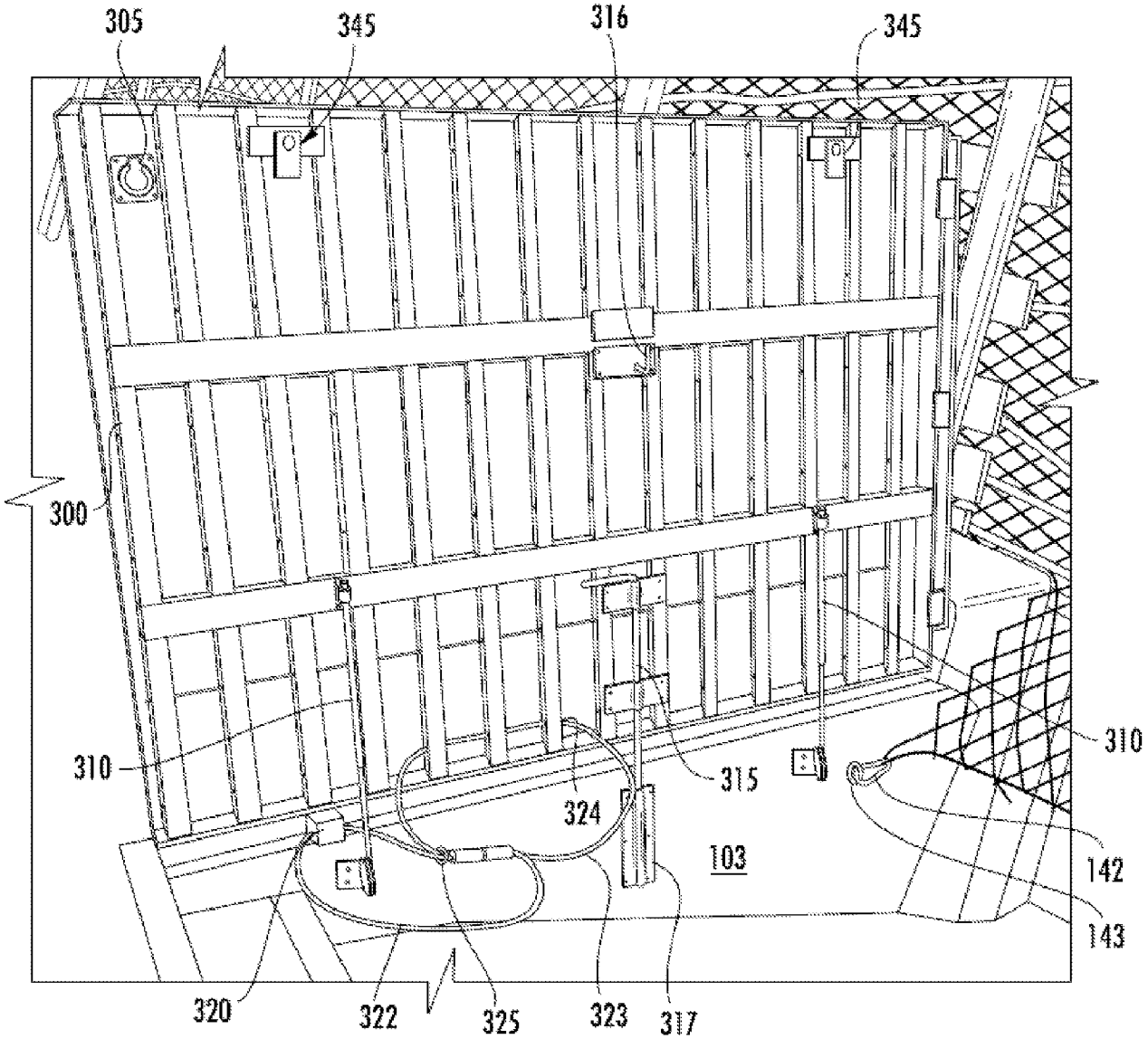
Figure 7:
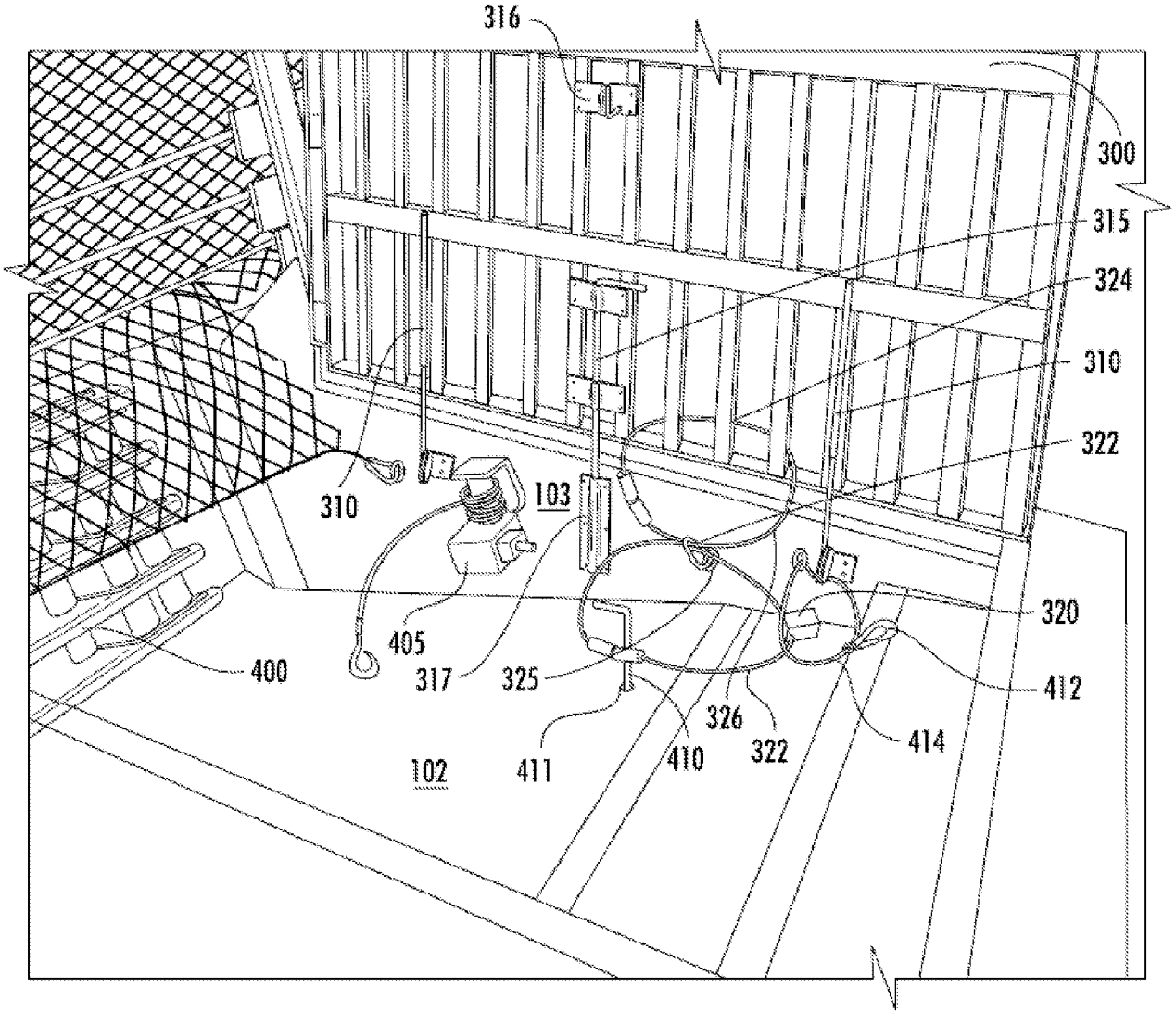
Figure 8:
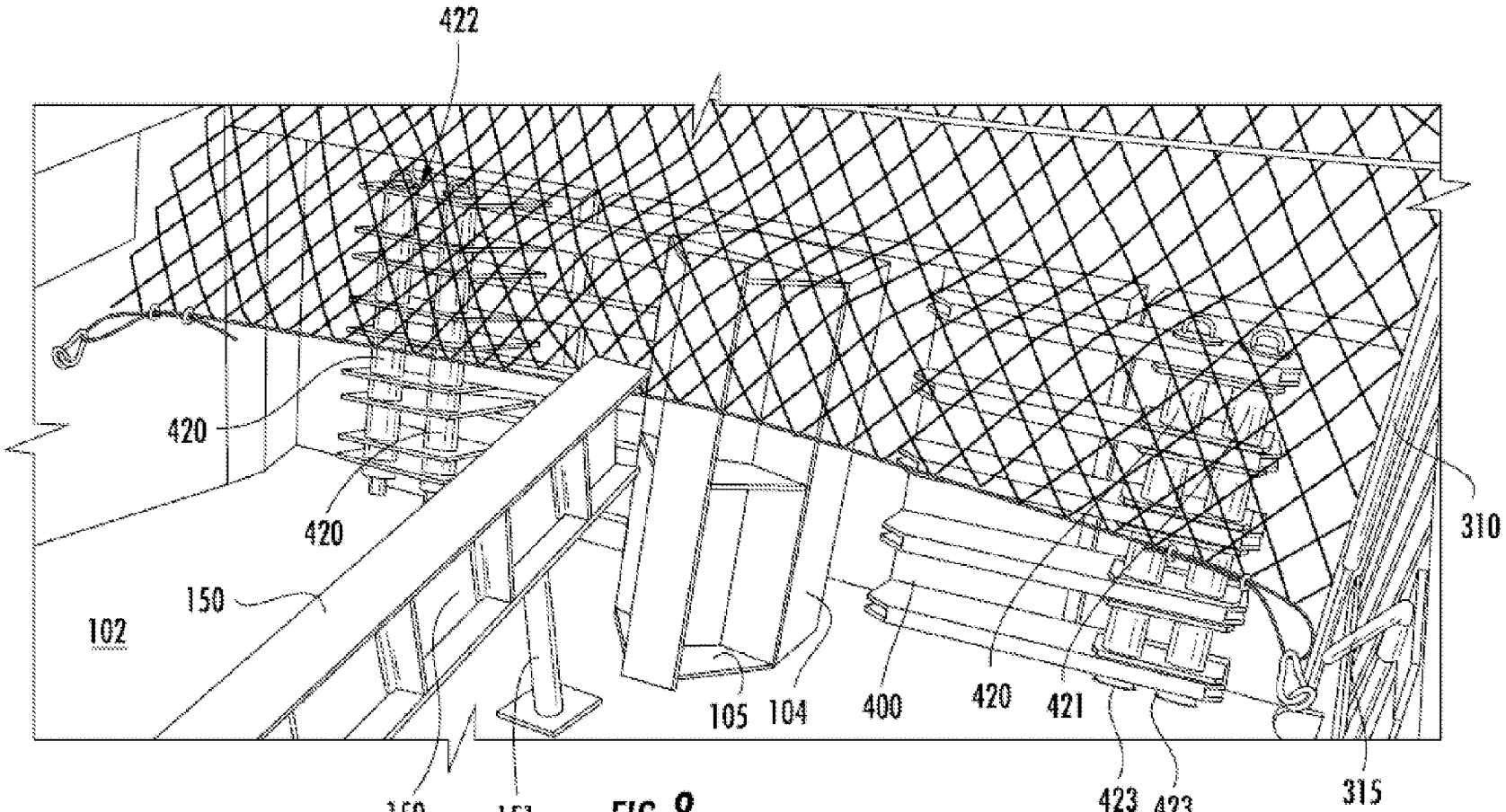
Figure 9:
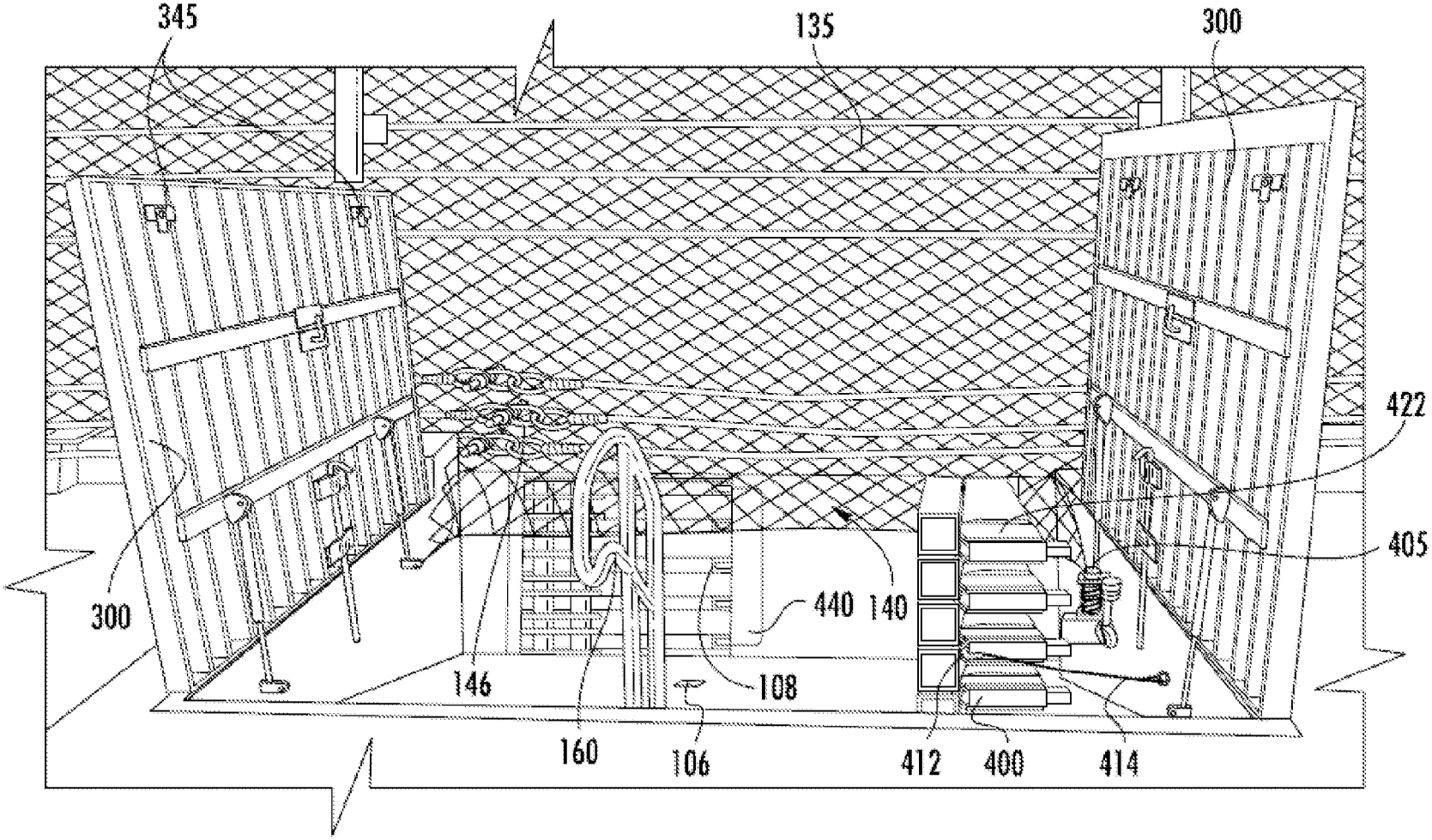
Figure 10:
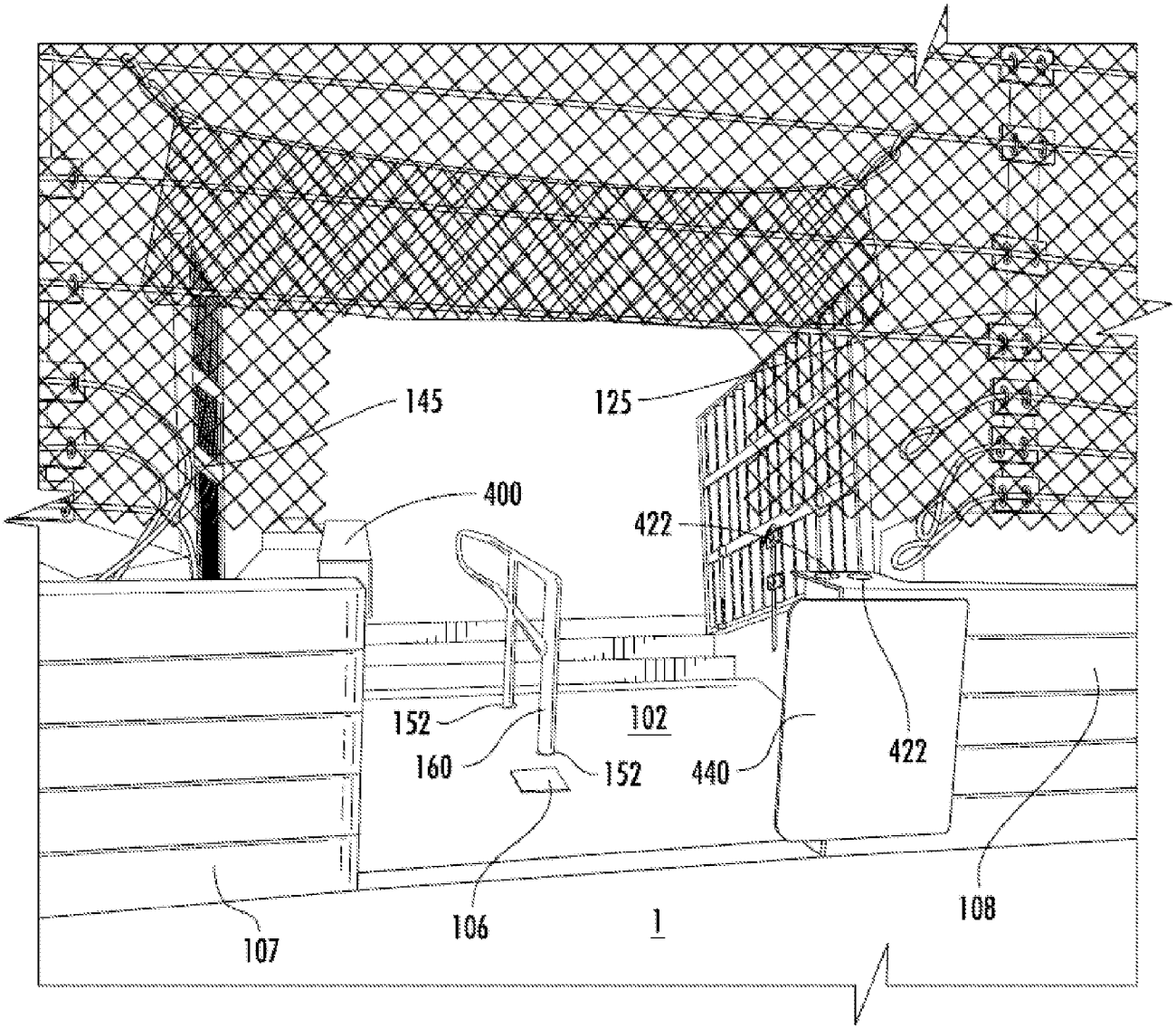
Figure 11:
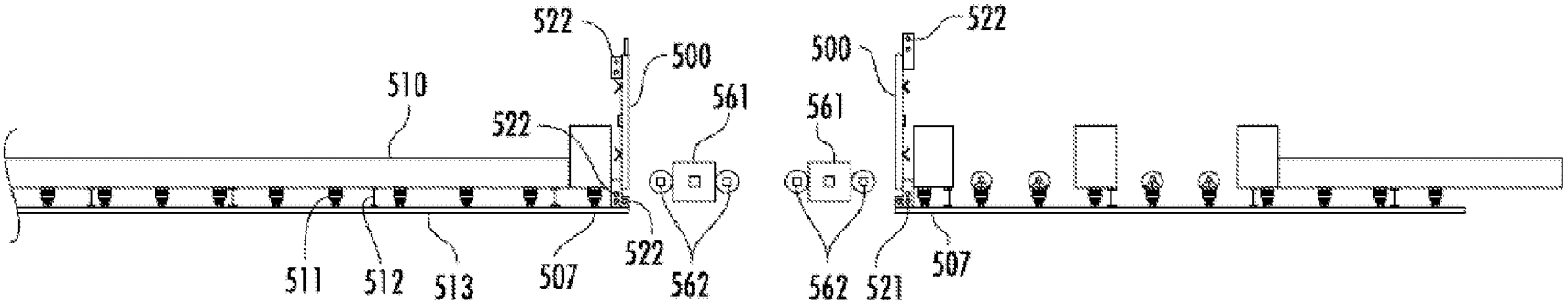
Figure 12:
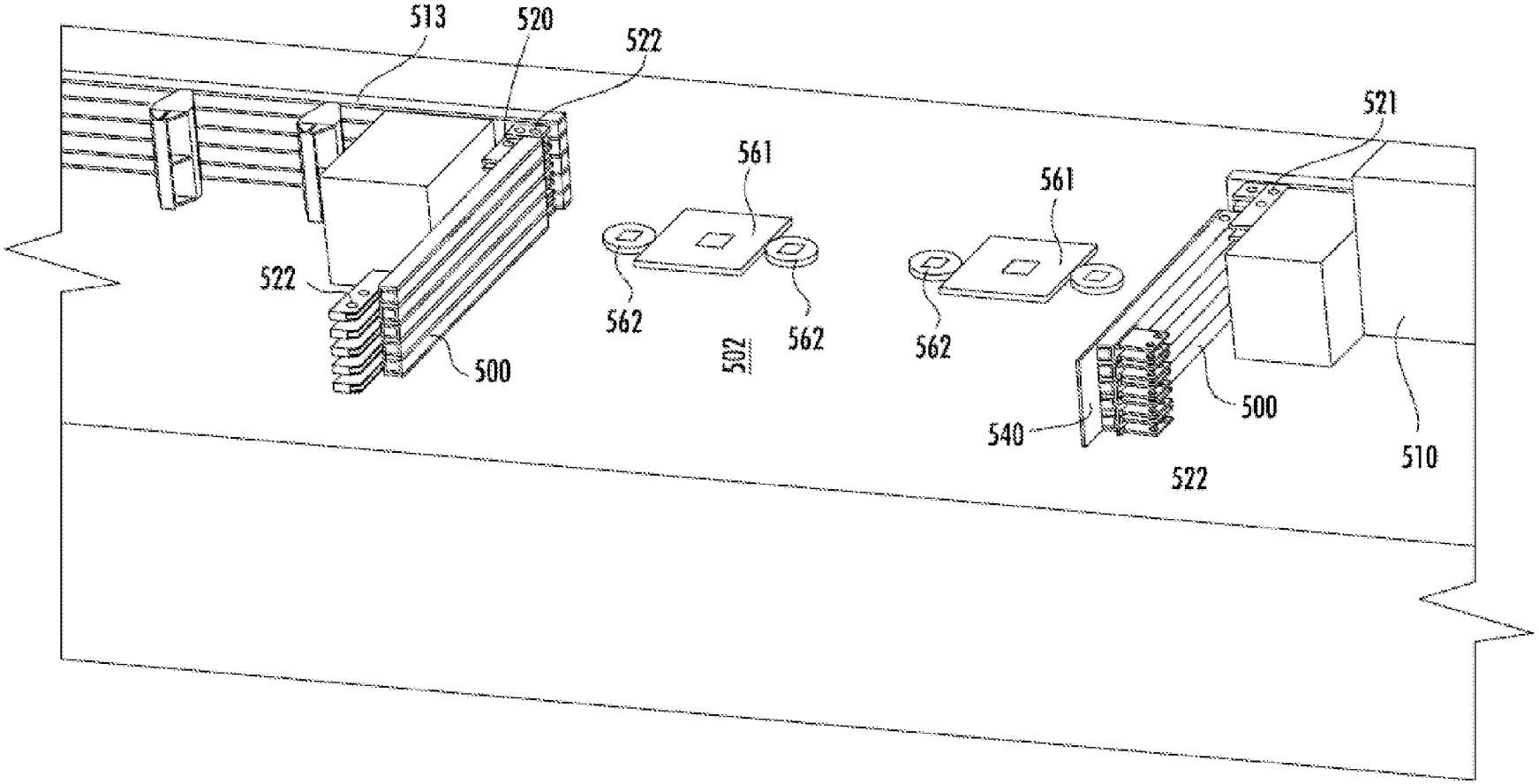
Figure 13:
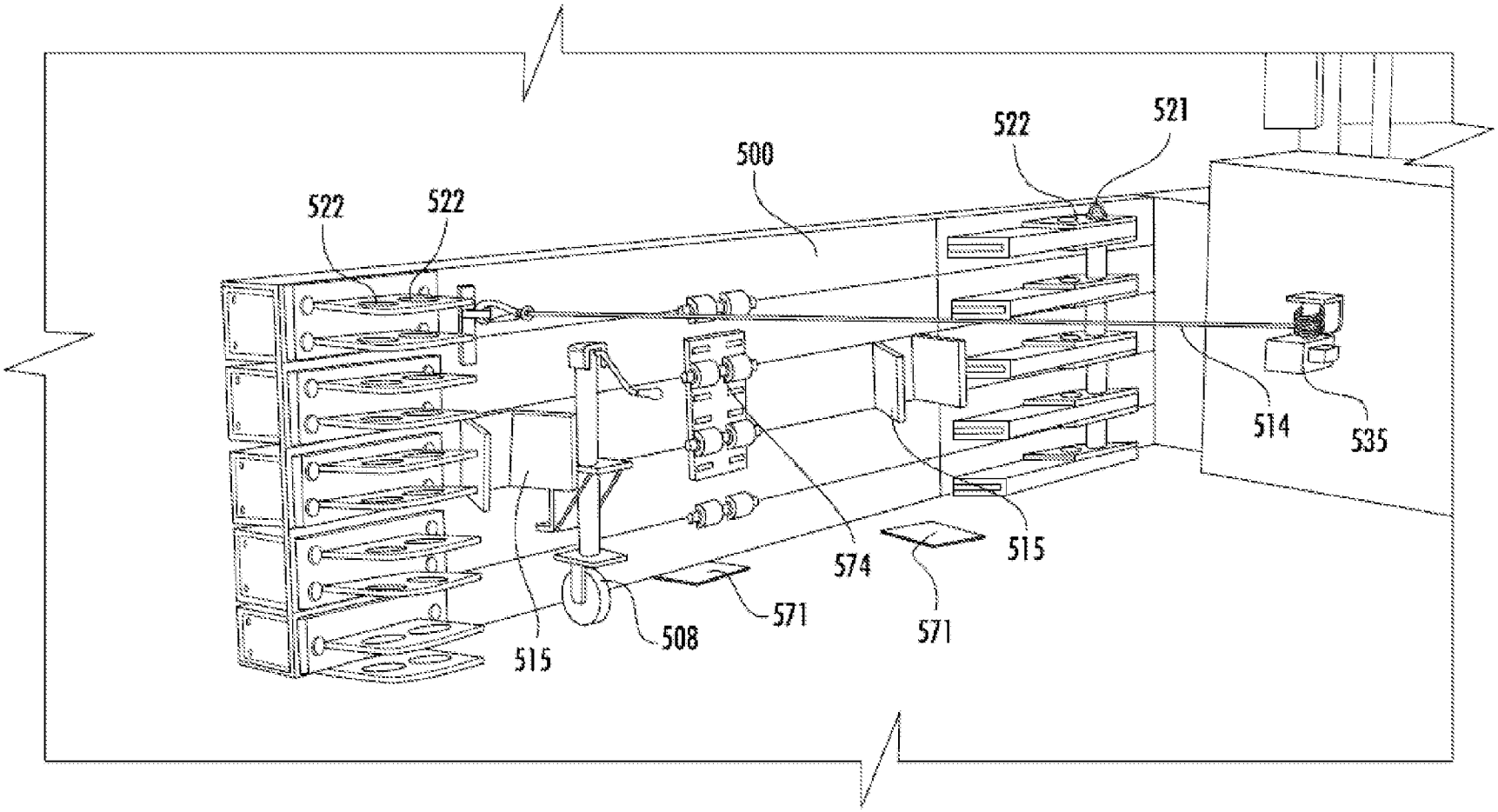
Figure 14:
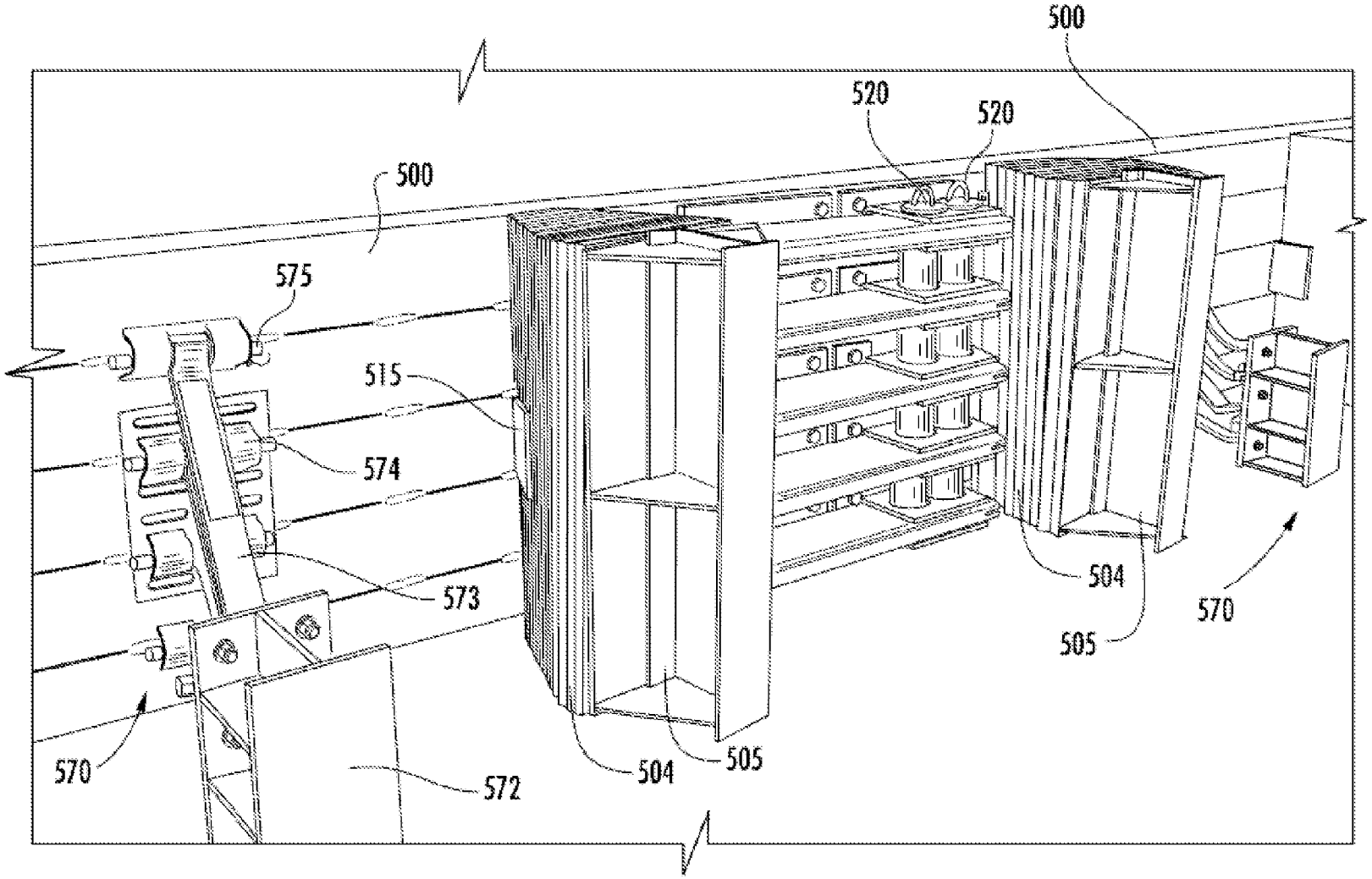
Figure 15:
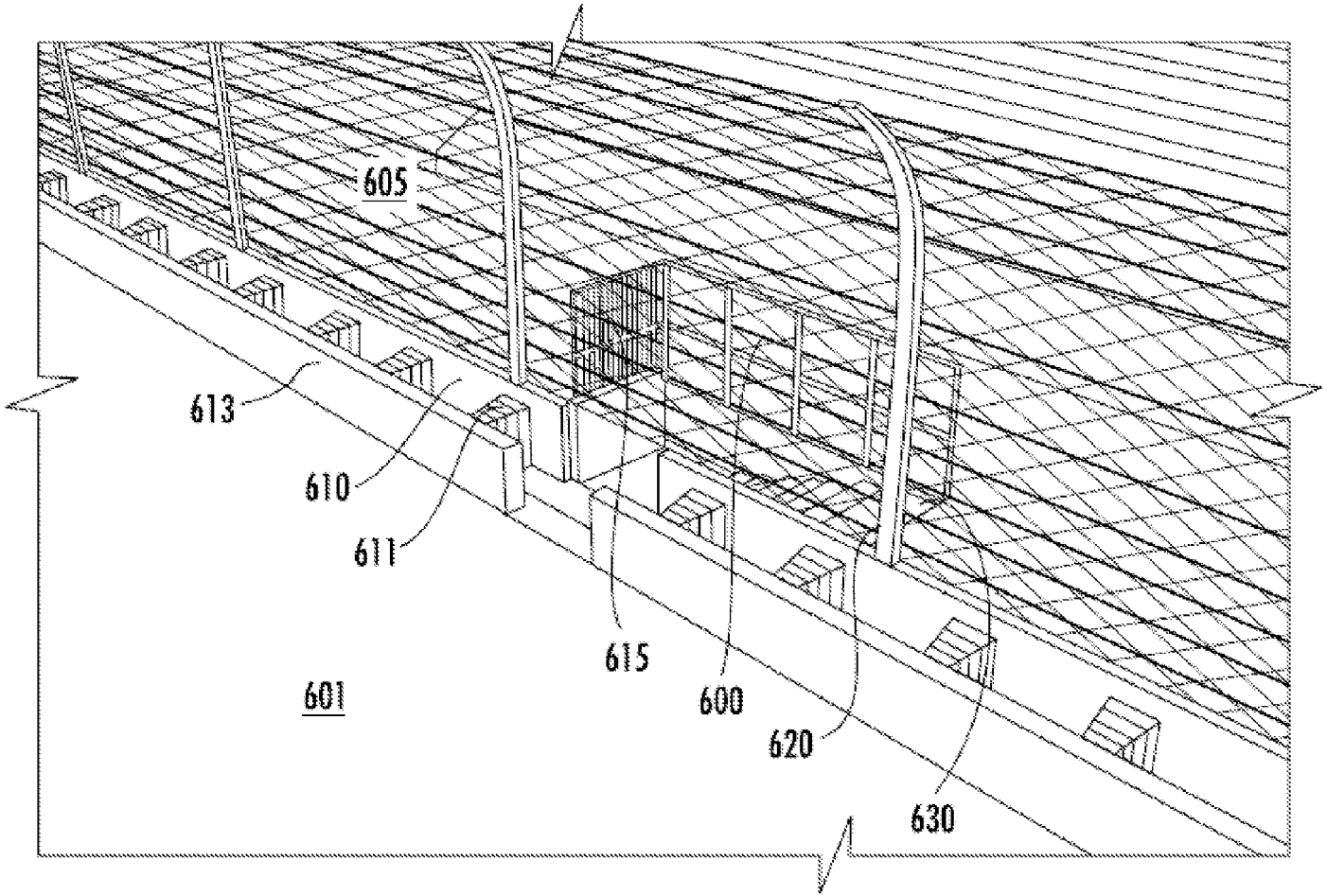
Figure 16:
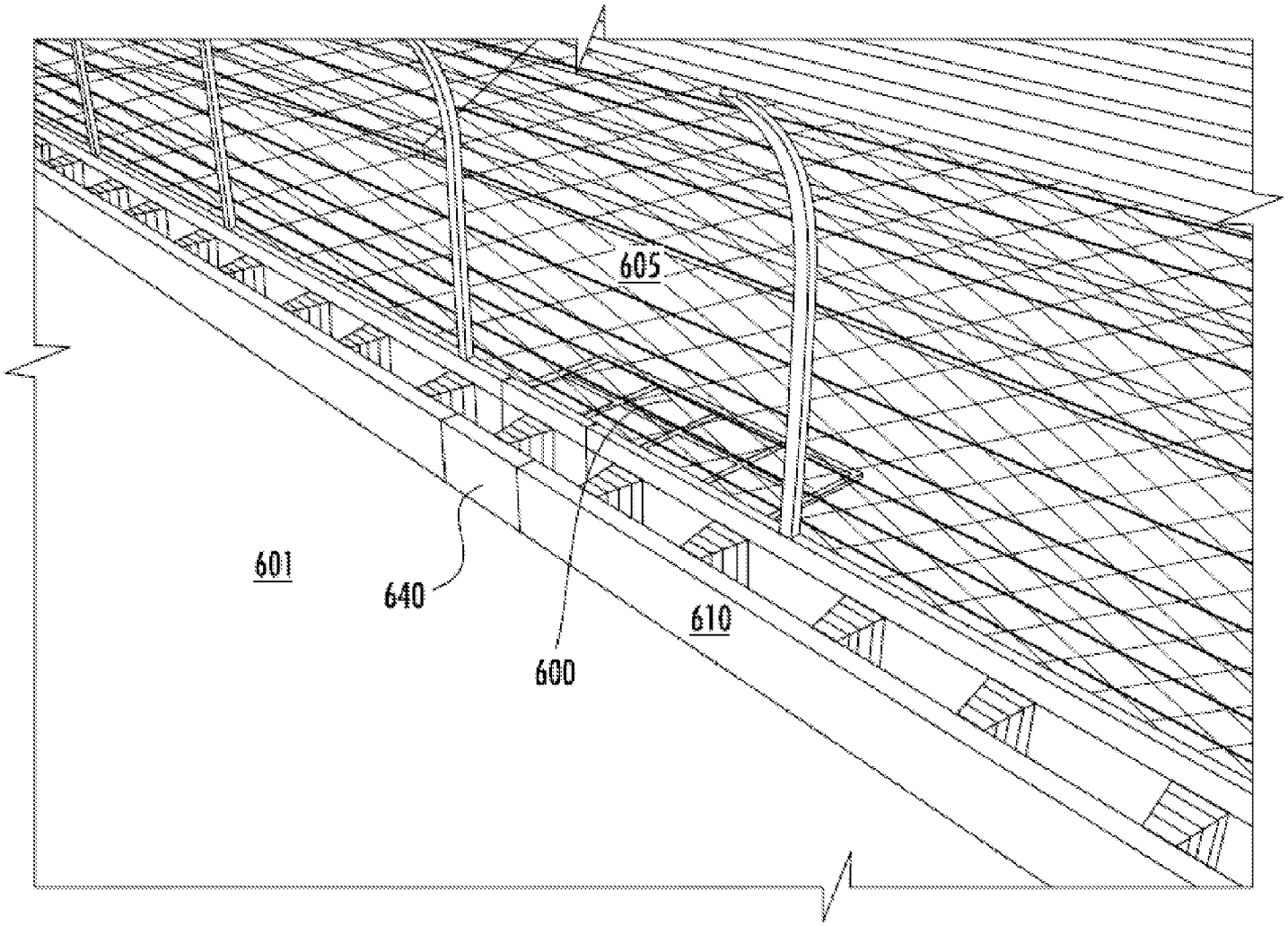
Figure 17:
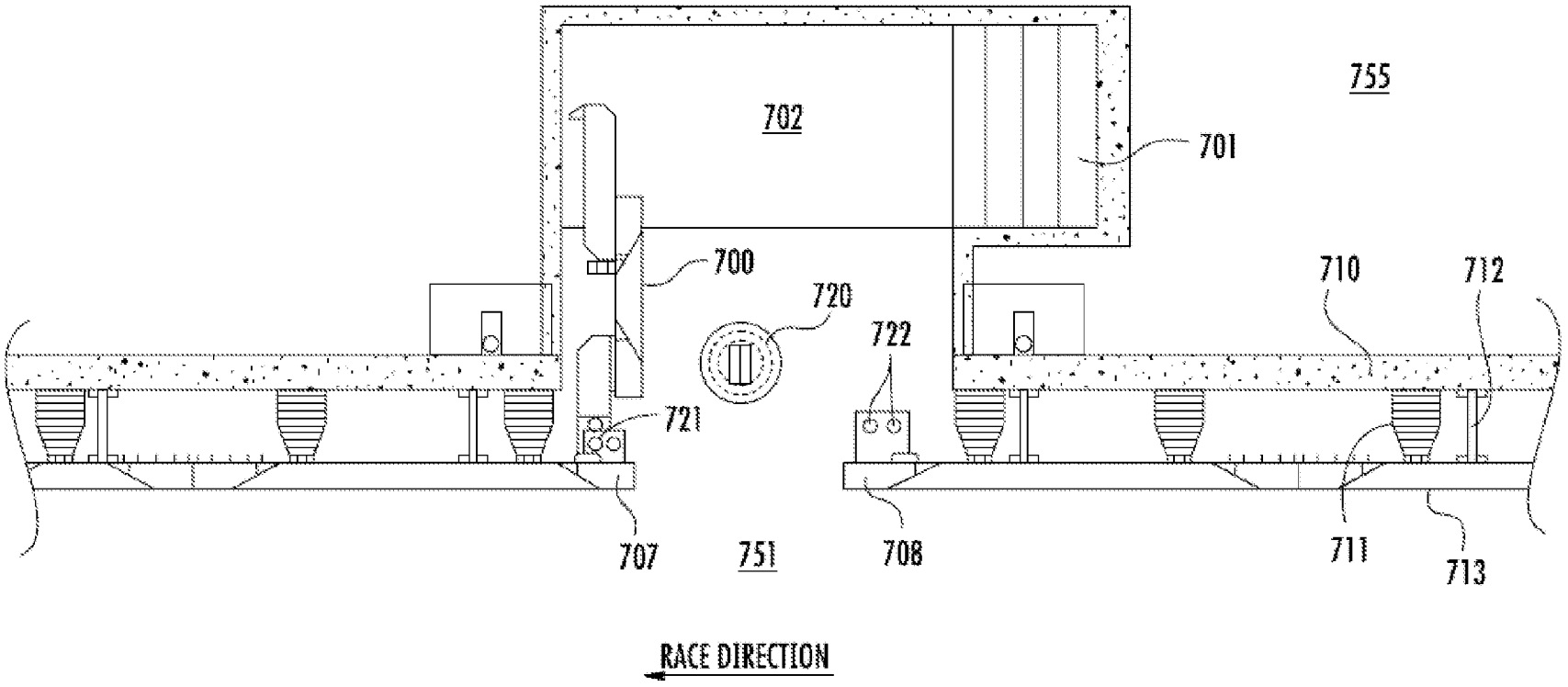
Figure 18:
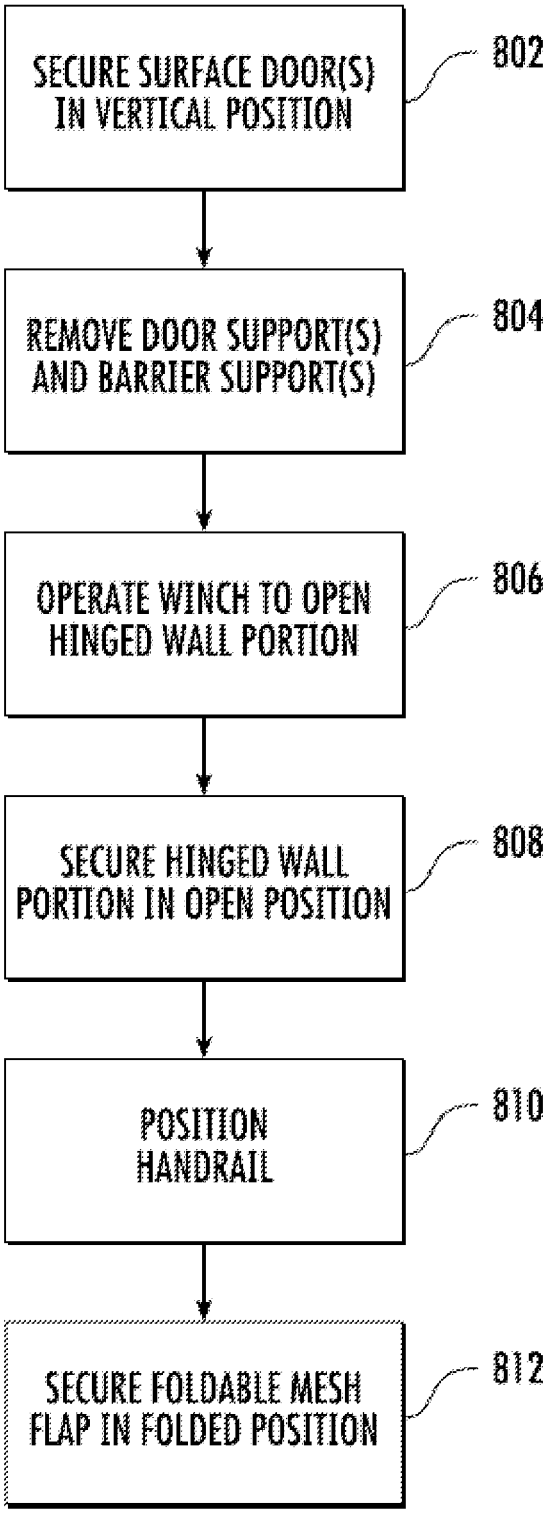

Having thus described certain embodiments of the invention in general terms, reference will now be made to the accompanying drawings, which are not necessarily drawn to scale, and wherein:

FIG. 1 is an overhead schematic view of a pedestrian access gate in accordance with an example embodiment of the present invention;

FIG. 2 is a cross-sectional view of a pedestrian access gate in accordance with an example embodiment of the present invention;

FIG. 3 is an overhead view of a reinforcing cage of a pedestrian access gate in accordance with an example embodiment of the present invention;

FIG. 4 illustrates a closed pedestrian access gate in accordance with an example embodiment of the present invention;

FIG. 5 is a side view of a pedestrian access gate with the surface doors in the open and/or approximately vertical position in accordance with an example embodiment of the present invention;

FIG. 6 illustrates a portion of a pedestrian access gate in accordance with an example embodiment of the present invention;

FIG. 7 provides another view of a pedestrian access gate in accordance with an example embodiment of the present invention;

FIG. 8 illustrates a hinged wall portion in the closed position in accordance with an example embodiment of the present invention;

FIG. 9 illustrates an open pedestrian access gate in accordance with an example embodiment of the present invention;

FIG. 10 provides another view of an open pedestrian access gate in accordance with an example embodiment of the present invention;

FIG. 11 is an overhead schematic view of an alternative design of an access gate;

FIG. 12 provides a perspective view of the access gate shown in FIG. 11;

FIG. 13 illustrates the access gate of FIG. 11 as the access gate is being opened;

FIG. 14 shows the access gate shown in FIG. 11 in a closed position;

FIG. 15 illustrates an open pedestrian access gate in accordance with an example embodiment of the present invention;

FIG. 16 shows a the pedestrian access gate shown in FIG. 15 in a closed position;

FIG. 17 is an overhead schematic view of an access gate in accordance with an example embodiment of the present invention; and FIG. 18 is a flow chart illustrating some processes and operations that may be completed in accordance with an embodiment off the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout.

Various aspects of the present invention will now be discussed herein regarding the example embodiment in which a wall and a fence acts a protective barrier around a race track (e.g., for racing cars, trucks, other vehicles, and/or the like). In this example, an access gate provides access for pedestrians (e.g., spectators, individuals, and/or the like) to cross the wall and fence from the stands area to the race track and vice versa for pre- or post-race activities. To provide for a better viewing experience for spectators, the stands area may be at a higher elevation than the race track. Therefore, in the above noted example, the elevation on one side of the wall may be higher than on the other side of the wall. However, it should be understood that the teachings of the present invention relate to a variety of situations in which an access gate may provide pedestrian, vehicular, or other access across a wall or other barrier.

In various embodiments, a wall may comprise an approximately vertical structure that impedes access across itself. In some embodiments, particularly embodiments in which the wall acts as a protective barrier, a fence (e.g., a catch fence) or the like may be positioned above the wall to prevent debris, people, and/or the like from crossing the barrier by going over the wall. Certain means for providing access to cross a wall provide steps and/or a ladder on one or both sides of the wall. This method of providing crossover access may limit the number and rate of pedestrians (e.g., spectators, individuals, and/or the like) who can cross the wall in a given time period and may provide additional safety concerns. In situations where a catch fence is positioned above the wall, a gate in the fence may allow pedestrians to pass through the fence. However, this may cause discontinuities in the fence and may require additional support structures (e.g., additional support posts and/or the like) to be employed to prevent debris and/or the like from crossing through the fence.

Various embodiments of the present invention provide an access gate that provides access for pedestrians (e.g., spectators, individuals, and/or the like) to cross a wall (e.g., a wall acting as a barrier between the stands and the race track, a wall dividing two areas of different elevation, and/or the like). Indeed, various embodiments of the present invention may allow multiple pedestrians (e.g., spectators, individuals, and/or the like) to cross the wall at the same time without additional safety concerns introduced by the use of stairs and/or a ladder. Additionally, in various embodiments of the present invention, a fence across the top of the wall may be provided to prevent debris and/or the like from crossing through the catch fence. Also, various embodiments provide methods for providing or preventing pedestrian access to cross a wall and through a fence.

Pedestrian Access Gate

FIG. 1 provides an overhead schematic view of an embodiment of a pedestrian access gate 100 in a closed position. A wall 10 separates the race track surface 1 from the stand area 5. In various embodiments, the wall 10 may be made of poured concrete or other appropriate material. The wall 10 may be associated with a barrier 13. In various embodiments, the barrier 13 may be constructed of multiple panels 109. The barrier 13 may be physically connected to the wall 10 via wall straps 12 (e.g., nylon wall straps and/or the like). Foam assemblies 11 may act as spacers between the wall 10 and the barrier 13 and may be configured to absorb at least part of the impact if the barrier 13 is hit by a vehicle or a part of a vehicle racing on the track, and/or the like.

The pedestrian access gate 100 includes a ramp 102 that, when the pedestrian access gate 100 is open may provide pedestrian access from the stand area 5 to the race track surface 1. In various embodiments, the ramp 102 may be any means of a crossing surface that may be a flat surface, a sloped surface, a set of stairs, or a combination of sloped and/or flat surfaces with one or more stairs, such as a walking and/or a driving surface. In one embodiment, for example the embodiment illustrated in FIG. 2, the ramp 102 includes two steps 101 at the end of the ramp closest to the stand area 5 and a sloped surface to the race track surface 1. In other embodiments, the ramp 102 may not include steps, but may include a ramp and/or the like where the steps 101 are illustrated in FIG. 2. For example, in some embodiments, the ramp 102 may be an American Disabilities Act (ADA) compliant ramp configured for providing wheelchair and/or other ADA-accessible access. In various embodiments, the ramp 102 may be constructed of poured concrete and/or other appropriate materials. In some embodiments, the concrete or other material that makes up the ramp 102 or other crossing surface, may be reinforced by one or more surface supports 225. For example, the surface supports 225 may each be a single rod or a collection thereof having a length approximately as long as the width of the ramp 102 and may be embedded within the concrete or other material of the ramp (e.g., may reinforce the concrete that makes the ramp 102) and run across the width of the ramp. For example, the surface supports 225 may be located approximately two to six inches below the surface of the ramp 102. In one embodiment, surface supports 225 may be located across the width of the ramp every eight or so inches around the entire perimeter of the ramp 102. The surface supports 225 may be made of number 6 rebar and/or other suitable materials.

Returning to FIG. 1, the pedestrian access gate 100 may also comprise a hinged wall portion 400. In one embodiment, the hinged wall portion 400 is one of the plurality of panels 109 that comprise a portion of the barrier 13. The hinged wall portion 400 may be configured to be moved or rotated into an open position to allow pedestrians (e.g., spectators, individuals, and/or the like) to access the race track surface 1 from the stand area 5, or vice versa. When a race is in progress, the hinged wall portion 400 may be secured in a closed position. When in the closed position, the hinged wall portion 400 may be configured to prevent egress from the race track surface 1 to the stand area 5, and vice versa, and/or to act as part of the barrier 13 to prevent debris from the race track from entering the stands area 5. For example, the barrier 13 may comprise a hinge panel 107 and a latch panel 108. In various embodiments, the hinged wall portion 400 is configured to hingedly attach to the hinge panel 107 and may rotate between open and closed positions about the hinged connection to the hinge panel 107. The hinged wall portion 400 may be configured to, when in the closed position, rest against and/or latch onto the latch panel 108. For example, in various embodiments, the latch panel 108 may include a latch plate 440 (shown in FIG. 9). The latch plate 440 may be configured to prevent the hinged wall portion 400 from over-rotating and angling over the race track surface 1 further than the rest of the barrier 13. When in the closed position, a portion of the hinged wall portion 400 may rest against or adjacent to the latch plate 440.

In various embodiments, when the hinged wall portion 400 is in the closed position, the hinged wall portion may be configured to act as part of barrier 13 and/or to otherwise prevent debris from the race track from entering the stand area 5. To this end, the hinged wall portion 400 may be reinforced by various elements when in the closed position. For example, a removable foam assembly 104 may be positioned behind the closed hinged wall portion 400. The removable foam assembly 104 may be configured to absorb at least some of the impact of a vehicle or part of a vehicle colliding with the hinged wall portion 400. A foam backing insert 105 may be positioned behind the removable foam assembly 104 to hold the removable foam assembly in the appropriate position during a race. For example, the foam backing insert 105 may comprise a steel beam and may be configured to be anchored into the ramp 102. For example, a sleeve configured to receive one end of the foam backing insert 105 may be positioned within the ground (e.g., concrete) of the ramp 102. As illustrated in FIG. 2, the ramp 102 may include a reinforcing cage 200 embedded within the ramp and configured to provide structural support for the ramp and the foam backing insert 105 in the instance of a vehicle or a part of a vehicle colliding with the hinged wall portion 400.

FIG. 3 illustrates an overhead view of the reinforcing cage 200. The reinforcing cage 200 may include a sleeve 205 for receiving the foam backing insert 105. The sleeve may be made of galvanized steel and/or another suitable material. The reinforcing cage 200 may also include one or more support structures, such as spiral structures (e.g., 215, 220), around the galvanized sleeve 205. In the illustrated embodiment, two spiral structures 215, 220 are provided. In one embodiment, one of the spiral structures 215 has a diameter of approximately 15 inches and the other spiral structure 220 has a diameter of approximately 21 inches. In one embodiment, each spiral structure 215, 220 has a pitch of approximately four inches. In some embodiments, the spiral structures do not have the same pitch. The spiral structures 215, 220 may be constructed of number 3 rebar or other suitable material. The reinforcing cage 200 may also comprise one or more vertical components 210. The vertical components 210 may be configured to hook onto and/or anchor the spiral components in the ground (e.g., concrete). For example, the vertical components 210 may have 12 inch hooks that hook onto and/or anchor the spiral components within the ground (e.g., concrete). In one embodiment, the vertical components 210 may be constructed of number 4 rebar or other suitable material. In various embodiments, the reinforcing cage 200 is configured to withstand a minimum collision force of 4,000 pounds per square inch. In one embodiment, at least one spiral structure 215, 220 may extend approximately three feet below the surface of the ramp 102.

FIG. 4 provides a view of the closed pedestrian access gate 100 from the perspective of the stand area 5. As noted above, in various embodiments a barrier 13 may be configured to prevent debris from the race track from entering the stand area 5. In various embodiments, a catch fence 120 may be positioned above the wall 10 and/or barrier 13 to prevent debris from the race track entering the stand area 5 over the top of the wall 10 and/or barrier 13. The catch fence 120 may comprise a plurality of catch fence supports 125, fence mesh 135, and fence support cables 130. The catch fence supports 125 may be configured to provide a vertical or partly vertical structure from which the fence mesh 135 and fence support cables 130 may be suspended. In various embodiments, fence support cables 130 may run approximately horizontally and/or approximately perpendicular to the catch fence supports 125 and may be configured to provide additional structural strength to the fence mesh 135. The fence mesh 135 may be configured to catch debris from the race track and prevent debris from entering the stand area 5 without significantly obscuring or interrupting the view of spectators in the stands.

The pedestrian access gate 100 may further include and/or be associated with a portion of the catch fence 120. In some embodiments, the portion of the catch fence 120 associated with the pedestrian access gate 100 may include a foldable mesh flap 140. The portion of the catch fence 120 associated with the pedestrian access gate 100 may also include one or more removable cable supports 145. The foldable mesh flap 140 and/or removable cable supports 145 may be secured in a closed position (as shown in FIG. 4), such as for during a race to help prevent debris from crossing between the race track 1 and the stand area 5. When the pedestrian access gate 100 is open, the foldable mesh flap 140 may be secured in a folded up position (as shown in FIG. 10) and the removable cable supports 145 may be disconnected, such as at shackle couplings 146, or removed. Securing the foldable mesh flap 140 in the folded up position and/or disconnecting or removing the removable cable supports 145 may provide additional headroom for pedestrians (e.g., spectators, individuals, and/or the like) passing through the pedestrian access gate 100.

To provide a surface for pedestrian and vehicle traffic within the stands when the pedestrian access gate is closed, one or more surface doors 300 may be provided. In various embodiments, the surface doors 300 may be constructed of galvanized steel or other appropriate material. The surface doors 300 may have one or more textured, non-slip, slip resistant and/or the like surfaces. Particularly, the surface doors 300 may be configured such that when pedestrians or vehicles travel across the surface doors 300 when the surface doors are in a closed, horizontal position, the pedestrians or vehicles may travel across the textured, non-slip, slip resistant and/or the like surface. In embodiments having two or more surface doors 300, the surface doors, when in the closed and/or approximately horizontal position, may configured to overlap in a manner that provides a smooth and/or level surface for pedestrian and/or vehicular traffic. Alternatively, the surface doors 300 may abut each other when in the closed and/or approximately horizontal position.

In various embodiments, the one or more surface doors 300 may include a locking mechanism configured to prevent the doors from inadvertently opening when in the closed and/or horizontal or approximately horizontal position. For example, the one or more surface doors 300 may each include one or more locking holes 340. A locking mechanism 345 may be positioned below the walkable and/or drivable surface provided by the one or more surface doors 300 in the closed and/or approximately horizontal position and be manipulated through the one or more locking holes 340. For example, a locking mechanism 345 (shown in FIG. 6) may be rotated by an individual reaching into or manipulating a tool or lever in the locking hole 340 when the surface door is in the closed and/or approximately horizontal position. In various embodiments, additional security may require a key, keyed tool, RFID key card, combination, and/or the like to lock and/or unlock the locking mechanism 345. This may prevent unauthorized individuals from locking and/or unlocking the one or more surface doors 300. Handles 305 may be recessed in the surface doors 300 to provide a means to pull open the surface doors 300.

FIG. 5 shows a side view of the surface doors 300 in an open and/or vertical or approximately vertical position. In various embodiments, the pedestrian access gate 100 may employ one or more door supports 150 configured to provide support for the one or more surface doors 300 when the surface doors are in the closed and/or horizontal or approximately horizontal position. For example, in the illustrated embodiment (see FIGS. 5 and 8), a door support 150 may be positioned such that both surface doors 300 may rest on the door support 150. The door support 150 may support the surface doors 300 sufficiently such that the surface doors may be H20 load rated and/or the like. In various embodiments, the door support 150 may include one or more support legs configured to rest on the surface of the ramp 102 and/or be positioned in corresponding holes 152 (see FIG. 1) in the ramp 102. For example, the door support 150 may comprise two approximately two inch legs 151 (see FIG. 8) that may rest in corresponding approximately two inch holes 152 in the ramp 102. In various embodiments, holes 152 in the ramp 102 corresponding to the door support 150 support legs 151 may be further configured to, in the absence of the door support 150 support legs 151, receive support legs associated with a handrail 160 (shown in FIG. 9).

FIG. 6 provides a view of the opposite side of the foreground surface door 300 shown in FIG. 5. In various embodiments, at least one pneumatic piston and/or other hydraulic element 310 may extend between the surface door 300 and the ramp wall 103 and may be configured to allow the surface door 300 to be opened or closed by a single person (e.g., via handle 305 shown in FIG. 5). When the surface door 300 is in the open and/or vertical or approximately vertical position, in addition to the piston and/or other hydraulic element 310, one or more safety elements may be used to ensure the surface door 300 will not inadvertently close. For example, locking pin 315 may be a rigid rod or dowel that extends between the surface door 300 and a locking sleeve 317 on the ramp wall 103 and is configured to prevent the surface door 300 from rotating between the open and/or vertical or approximately vertical position and the closed and/or horizontal or approximately horizontal position. When not in use, the locking pin 315 may be disengaged from the locking sleeve 317 and retained in an open position by hook 316. In another example, locking block 320 may be a rigid block configured to be positioned between a lower edge of the surface door 300 and an upper lip of the ramp wall 103 when the surface door 300 is in the open and/or vertical or approximately vertical position. The locking block 320 may be configured to prevent the surface door 300 from rotating from the open position toward or to the closed position. In various embodiments, these and other safety elements may be used to ensure the surface door 300 does not inadvertently close.

In various embodiments, as illustrated in FIG. 6, various elements of the pedestrian access gate 100 may be directly secured into the ramp 102 and/or ramp wall 103 and/or secured via cabling. This may prevent various elements of the pedestrian access gate 100 from being removed from the area around the gate and getting lost and/or coming loose, such as in the case of a collision between a racing vehicle or a portion of a racing vehicle and the hinged wall portion 400. For example, the locking block 320 may be attached to an eyelet 325 secured into the concrete or other material of the ramp wall 103 via a cable loop 322. Similarly, another cable loop 323 may pass through holes 324 in the surface door 300 to secure the surface door 300 to an eyelet 325 secured in the concrete or other material of the ramp wall 103. In another example, the foldable fence mesh 140, when in the closed position, may be secured to an eyelet 143 secured in the ramp wall 103 via one or more fence clips 142. Various other elements of the pedestrian access gate 100 may also be secured directly into the ramp 102 and/or ramp wall 103 and/or secured via cabling.

FIG. 7 shows another view of a ramp wall 103 and surface door 300. A winch 405 may be secured to the ramp wall 103, ramp 102, or other appropriate surface. The winch 405 may be configured to cause the hinged wall portion 400 to rotate between open and closed positions. The winch 405 may also be configured to maintain tension on the hinged wall portion 400 when the hinged wall portion is in the open position to prevent the hinged wall portion from inadvertently closing. In various embodiments, the winch 405 may be manually cranked or mechanically driven. For example, the winch 405 may be operated with a corded or cordless drill/driver, such as a cordless impact wrench. In various embodiments, the winch 405 may need to be cranked and/or driven with approximately five foot-pounds of torque or more to rotate the hinged wall portion 400 from the closed position to the open position. In various embodiments, a gate lock 410 may be used to lock the hinged wall portion 400 in the open position and prevent the hinged wall portion 400 from inadvertently closing. In various embodiments, other safety elements may be used to prevent the hinged wall portion 400 from rotating between the open and closed position inadvertently. For example, gate cable 414 may be secured at one end to an eyelet secured to the ramp wall 103 and, at the other end, be secured via a hook 412 or other mechanism to the hinged wall portion 400 (as shown in FIG. 9). The gate cable 414 and hook 412 may be configured to prevent the hinged wall portion 400 from inadvertently rotating between the open and closed positions and/or exerting strain on the winch 405.

FIG. 8 illustrates various safety elements that may be used to hold the hinged wall portion 400 in the closed position (e.g., during a race). For example, at least one gate pin 420, 421 may be inserted through an appropriate portion (e.g., a gate pin pathway 422) of the hinged wall portion 400 and inserted into a corresponding hole 423 in the ramp 102 for receiving the gate pin 420, 421. In one embodiment, a gate pin 420, 421 may be approximately 2 inches in diameter. A gate pin 420, 421 may be made of steel or other appropriate material. A gate pin pathway 422 may, for example, be appropriately sized holes in a steel plate welded or otherwise secured to the hinged wall portion 400, a series of steel plates welded or otherwise secured to the hinged wall portion, one or more plates made of another appropriate material secured to the hinged wall portion, and/or the like. In various embodiments, at least one gate pin 420,421 may be used on each end of the hinged wall portion 400. In the illustrated embodiment, two gate pins 420, 421 are used on each end of the hinged wall portion 400 to prevent the hinged wall portion from being rotated or otherwise moved when the hinged wall portion is the in the closed position. In various embodiments, the hinge panel 107 and/or the latch panel 108 may be configured to overlap with the hinged wall portion 400 such that when a gate pin 420, 421 is inserted into the gate pin pathway 422 on the hinged wall portion 400, the gate pin 420, 421 is also being inserted into a corresponding gate pin pathway 422 on the hinge panel 107 or latch panel 108. Overlapping the hinge panel 107 and/or the latch panel 108 with the hinged wall portion 400 in this manner may increase the stability of the hinged wall portion, the hinge panel, the latch panel, and/or the barrier 13.

In various embodiments, a gate pin 421 may be used as the hinge pin about which the hinged wall portion 400 may rotate. Therefore, in such embodiments, the corresponding gate pin pathway 422 may act as the knuckles of the hinge.

For example, in one embodiment, to open the hinged wall portion 400, all the gate pins 420 other than the gate pin 421 located closest to the hinge panel 107 may be removed. The gate pin 421 located closest to the hinge panel 107 may then be used as the hinge pin about which the hinged wall portion 400 rotates. In various embodiments, other hinge mechanisms may be used to connect the hinged wall portion 400 to the hinge panel 108.

As noted above, when the hinged wall portion 400 is in the closed position (e.g., during a race), a removable foam assembly 104 may be used to absorb at least part of the impact from a collision between a vehicle and/or a portion of vehicle and the hinged wall portion 400. The foam assembly 104 may be held in the appropriate position by a foam backing insert 105 that extends down into a corresponding sleeve 205 in the ramp 102. In some embodiments, the hinged wall portion 400 may also include one or more foam retention plates (e.g., similar to foam retention plates 515 shown in FIG. 13 and discussed in detail below). Additionally, when the pedestrian access gate 100 is closed, a door support 150 may be positioned along the length of the ramp 102 to support the surface doors 300 in the closed and/or horizontal or approximately horizontal position. In various embodiments, the door support 150 may be further configured to reinforce the hinged wall portion 400, absorb at least a part of the impact of a collision between the hinged wall portion and vehicle and/or portion of a vehicle, and/or the like.

FIG. 9 shows an embodiment of the pedestrian access gate 100 with the surface doors 300 in the open and/or vertical or approximately vertical position, the hinged gate portion 400 in the open position, and the foldable fence mesh 140 in the closed position. For example, the winch 405 may have been operated to rotate the hinged wall portion 400 about hinge pin 421 from the closed position to the open position. In various embodiments, the winch 405 may be manually cranked or mechanically driven to cause the hinged wall portion 400 to rotate between the closed and open positions. For example, the winch 405 may be operated with a corded or cordless drill/driver, such as a cordless impact wrench. In various embodiments, the winch 405 may need to be cranked and/or driven with approximately five foot-pounds of torque or more to rotate the hinged wall portion 400 from the closed position to the open position. When the winch 405 is cranked or driven, the winch may exert a force on the hinged wall portion 400 via a cable clipped, hooked, and/or otherwise secured to the hinged wall portion 400. When the hinged wall portion 400 is in the open position, gate cable 414 may be secured at one end to the hinged wall portion (e.g., via hook 412 secured to gate pin pathway 422 and/or the like). The other end of the gate cable 414 may be secured to an eyelet secured to the ramp wall 103. Thus, the gate cable 414 may be configured to prevent the hinged wall portion 400 from inadvertently rotating from the open position to the closed position.

In the open position, the hinged wall portion 400 is rotated such that pedestrians (e.g., spectators, individuals, and/or the like) or vehicles may pass from the ramp 102 to the race track surface 1 and vice versa. The hinged wall portion 400 and/or the hinge panel 108 define one side of the passageway through which pedestrians (e.g., spectators, individuals, and/or the like) or vehicles may pass through between the ramp 102 and the race track 1. The latch panel 107 and/or the latch plate 440 may define the other side of the passageway through which pedestrians or vehicles may pass through between the ramp 102 and the race track surface 1. The latch plate 440 may be welded or otherwise secured to the latch panel 107 such that, when the hinged wall portion 400 is in the closed portion, the latch panel 440 prevents the hinged wall portion 400 from over-rotating and angling over the race track surface 1 further than the rest of the barrier 13. The latch plate 440 may be a steel plate or a plate made of an appropriate material.

In various embodiments, one or more permanent or removable handrails 160 may be positioned along the length of the ramp 102. In some embodiments, a handrail 160 may be located along one of the ramp walls 103, located along the middle of the ramp 102, and/or in some other position along the ramp 102. The handrail 160 may be configured to aid pedestrians needing assistance walking up or down the ramp 102, to help organize one or more traffic flows along the ramp, such as to create multiple paths of traffic flow and/or aid in directing the flow of traffic, and/or the like. In various embodiments, the handrail 160 may be secured to the ramp wall 103 (e.g., if the handrail is located along the ramp wall) or may include support legs configured to rest upon the surface of the ramp 102 or to be received by corresponding holes in the ramp (e.g., support leg holes 152), as described above. In various embodiments, the handrail 160 may be constructed of a rigid yet light material (e.g., aluminum and/or the like). In embodiments in which the handrail 160 is removable, the handrail may be configured such that the handrail may be positioned and/or removed by a single person and/or a pair of people.

As noted above, a foam backing insert 105 extends into the ramp 102 (e.g., into the concrete and/or into a sleeve 205 configured for receiving the foam backing insert 105). The removable foam assembly 104 and foam backing insert 105 may be removed so that the hinged wall portion 400 can be rotated into the open position. Sleeve cover 106 may be inserted into the sleeve 205 or across the opening of the sleeve to prevent pedestrians (e.g., spectators, individuals, and/or the like) from accidentally stepping in or tripping on the sleeve 205 or other hole in the surface of the ramp 102.

FIG. 10 provides a view of an open pedestrian access gate 100 from the perspective of the race track. The surface doors 300 are secured in the open and/or approximately vertical position. The hinged wall portion 400 is secured in the open position. The support legs for handrail 160 have been positioned in the corresponding holes 152 in the ramp 102. The foldable mesh flap 140 is secured in the open and/or folded position by fence clips 142. Additionally, the removable cable supports 145 have been removed and/or disconnected to allow for additional headroom for pedestrians (e.g., spectators, individuals, and/or the like) passing through pedestrian access gate 100.

In various embodiments, the opening in the barrier 13 provided by the pedestrian access gate 100 may be approximately five feet wide (e.g., four feet and eight inches wide). The hinged wall portion may also be approximately five feet wide (e.g., five feet and three and a half inches wide). In various embodiments, the ramp 102 may be approximately ten feet wide. In various embodiments, the pedestrian access gate 100 may be configured to allow approximately 100 pedestrians (e.g., spectators, individuals, and/or the like) to pass through the pedestrian access gate 100 (e.g., from the race track surface 1 to the stands area 5 or vice versa) per minute.

FIGS. 11-14 illustrate an alternative access gate design. This alternative gate design includes two hinged wall portions 500 that are positioned adjacent each other. A wall 510 may separate the race track surface from the stand area or from an ingress or egress point. The wall 510 may be made of poured concrete or other appropriate material. The wall 510 may be associated with a barrier 513. The barrier 513 may be physically connected to the wall 510 via wall straps 512. Foam assemblies 511 may act as spacers between the wall 510 and the barrier 513 and may be configured to absorb at least part of the impact if the barrier 513 is hit by a vehicle or a part of a vehicle racing on the track, and/or the like.

In this alternative gate design, each hinged wall portion 500 is associated with a hinge panel 507 and acts as the latch panel for the other hinged wall portion 500. Each hinged wall portion 500 may be associated with a winch 535 that may be operated to open and/or close the hinged wall portion (e.g., via winch cable 514). A hinged wall portion 500 may also be provided with one or more wheels 508 upon which the hinged wall portion may roll. The wheel 508 may be configured to support part of the weight of the hinged wall portion 500. Similar to that described above, gate pins 520, 521 may be configured to be inserted into gate pin pathways 522. Each hinged wall portion 500 may have one or more gate pin pathways 522 configured to receive an associated gate pin 520, 521. In the illustrated example, each hinged wall portion 500 includes two gate pin pathways 522 adjacent the corresponding hinge panel 507. For example, each hinged wall portion 500 may include two gate pin pathways 522 that overlap with the corresponding gate pin pathway of the corresponding hinge panel 507. Each gate pin 520, 521 may be received by the corresponding gate pin pathway 522 and a corresponding hole in the crossing surface 502. The gate pin 521 located closest to the corresponding hinge panel 507 may act as the hinge pin about which the hinged wall portion 500 rotates, and the corresponding gate pin pathway 522 may act as the knuckles of the hinge. Additionally each hinged wall portion 500 includes two gate pin pathways 522 on the end of the hinged wall portion 500 adjacent the other hinged wall portion 500. Thus, when both hinged wall portions 500 are in the closed position, one or more gate pins 520 may be inserted into gate pin pathways 522 associated with both hinged wall portions 500, as shown in FIG. 14.

At least one removable foam assembly 504 and a corresponding foam backing insert 505 may be configured to absorb at least part of the impact if a vehicle or a portion of a vehicle collides with the hinged wall portion 500. Each removable foam assembly 504 may be held in place with respect to the hinged wall portion 500 by a pair of foam plates 515. The foam plates 515 may be made of galvanized steel or other appropriate material and configured to keep the foam assembly 504 from sliding along the length of the hinged wall portion 500. Thus, the foam plates 515 may be configured to assist with holding the removable foam assembly 504 in the appropriate position. Each foam backing insert 505 may be configured to be received by a reinforced sleeve 561 (e.g., similar to sleeve 205). When the removable foam assembly 504 and foam backing insert 505 are removed (e.g., when the access gate is in the open position), a sleeve cover 571 may be used to cover the reinforced sleeve 561 such that the reinforced sleeve 561 does not become a tripping hazard or the like while the access gate is in use (e.g., in the open position).

Unlike the embodiment of the present invention illustrated in FIG. 10, the alternative access gate design illustrated in FIGS. 11-14 may not include a latch plate 440. Rather, the alternative access gate design shown in FIGS. 11-14 uses a strap support system 570 to prevent the hinged wall portions 500 from extending out onto the race track, in addition to the gate pins 520, 521 extending into corresponding holes in the ground (e.g., concrete). For example, support anchor 572 may be anchored in the ground (e.g., concrete), possibly in a similar manner as the foam insert backer 105 (e.g., via a sleeve 205). For example, a portion of the support anchor 572 may be configured to be received by sleeve 562 recessed into the crossing surface 502. One or more straps 573 are attached by one end of the strap to the support anchor 572 and attached to the hinged wall portion 500 by the second end of the strap. Particularly, the second end of the strap 573 may include a loop. A lock rod 575 may be secured within a strap attachment panel 574 such that the lock rod is securely contained within the strap attachment panel 574 and such that the lock rod passes through the loop on the second end of the strap 573. The support anchor 572 may be constructed of galvanized steel or other appropriate material. The straps 573 may be constructed of nylon webbing or other material with an appropriate tensile strength. The strap attachment panel 575 may be constructed of a plate of galvanized steel and/or the like welded or otherwise adhered to the hinged wall portion 500. A support anchor 572 may be secured to four straps 573, each of which is secured to the hinged wall portion 500 via a strap attachment panel 575. The straps 573 may be unattached from the hinged wall portion 500 and the support anchors 572 may be removed before the hinged wall portion is rotated into the open position. A sleeve cover 571 may be used to cover the hole or sleeve configured to receive the anchor support 572 when the anchor support is removed. Use of the sleeve cover 571 may prevent the hole or sleeve 562 configured to receive the anchor support 572 from being a tripping hazard, for example, when the access gate is in use.

In the alternative access gate design illustrated in FIGS. 11-14, because the access gate includes two hinged wall portions 500, the access gate may be wide enough to allow vehicular traffic to use the gate as an access point to the race track in addition to providing pedestrian access. A single hinged wall portion of sufficient width to allow for vehicular traffic to pass through the access gate is also contemplated. Various aspects of the illustrated alternative gate design may be incorporated into various embodiments of the present invention. For example, an embodiment of the present invention is contemplated in which two hinged wall portions are positioned adjacent each other.

FIGS. 15 and 16 illustrate an alternative embodiment of the present invention. Particularly, FIG. 15 illustrates an embodiment of an access gate in the open position and FIG. 16 illustrates the embodiment of the access gate in the closed position. A wall 610 may separate the race track surface 601 from the stand area 605. In various embodiments, the wall 610 may be made of poured concrete or other appropriate material. The wall 610 may be associated with a barrier 613. Foam assemblies 611 may act as spacers between the wall 610 and the barrier 613 and may be configured to absorb at least part of the impact if the barrier 613 is hit by a vehicle or a part of a vehicle racing on the track, and/or the like. A catch fence 620 may be positioned above the wall 610 and/or barrier 613 and configured to prevent debris from entering the stands area 605. The illustrated embodiment includes a surface door 600 similar to surface door 300 described above. The surface door 600 may be configured to move between a closed and/or horizontal or approximately horizontal position and an open and/or vertical or approximately vertical position. When the surface door 600 is in the closed position, the surface door prevents pedestrians (e.g., spectators, individuals, and/or the like) from accessing the stairway 630 and provides a walkable and/or drivable surface. When the surface door 600 is in the open position, the surface door guides pedestrians (e.g., spectators, individuals, and/or the like) to the entry of stairway 630 so that the pedestrians may access the access gate. The illustrated embodiment also includes end gate 615. When the surface door 600 is in the closed, the end gate 615 may be removed and stowed away for later use (e.g., in stairway 630 and/or the like). When the surface door 600 is in the open position, the end gate 615 may prevent pedestrians (e.g., spectators, individuals, and/or the like) from accidentally entering stairway 630 at the wrong end and/or the end gate 615 may guide pedestrians to the entry to stairway 630.

In various embodiments, a wall portion 640 may be rotated or moved into an open position to allow pedestrians (e.g., spectators, individuals, and/or the like) to cross the wall 610 through the access gate. The wall portion 640 may be secured into a closed position to prevent pedestrians from crossing through the access gate (e.g., during a race or other time when pedestrians should not be on the race track). The wall portion 640 may be secured such that wall portion acts to prevent debris from the race track from crossing into the stands.

FIG. 17 illustrates an additional embodiment of an access gate. A wall 710 acts to separate a race track surface 751 from a stands area 755. In various embodiments, the wall 710 may be made of poured concrete or other appropriate material. The wall 710 may be associated with a barrier 713. The barrier 713 may be physically connected to the wall 710 via wall straps 712. Foam assemblies 711 may act as spacers between the wall 710 and the barrier 713 and may be configured to absorb at least part of the impact if the barrier 713 is hit by a vehicle or a part of a vehicle racing on the track, and/or the like. In various embodiments, the wall 710 and/or the barrier 713 may be associated with a catch fence, as described above.

The barrier 713 may comprise a number of panels. For example, the barrier 713 may include a hinge panel 707, a hinged wall portion 700, and a latch panel 708. Hinge panel 707 may include one or more hinge pin pathways 722 corresponding to one or more hinge pin pathways 722 of the hinged wall portion 700. For example, the end of the hinged wall portion 700 closest to the hinge panel 707 may include two gate pin pathways 722 that correspond to two gate pin pathways 722 on the hinge panel 707. A hinge pin 721 may be used in one of the gate pin pathways 722 of the hinge panel 707 and the hinged wall portion 700 to act as the hinge pin about which the hinged wall portion 700 may rotate. For example, the hinged wall portion 700 may be rotated about the hinge pin 721 when force is applied to the hinged wall portion 700 via a winch, as described above. The latch panel 708 may also include one or more gate pin pathways 722 corresponding to gate pin pathways 722 located on the hinged wall portion 700. For example, the latch panel 708 may include two gate pin pathways 722 that correspond to two gate pin pathways located on the end of the hinged wall portion 700 farthest from the hinge panel 708. When the hinged wall portion 700 is in the closed position, gate pins 720 may be positioned in the gate pin pathways 722 to secure the hinged wall portion 700 in the closed position.

In various embodiments, when the hinged wall portion 700 is in the closed position, a removable foam assembly (similar to 104) and a foam backing insert (similar to 105) may be used to absorb at least a portion of any impact between a vehicle and/or a portion of a vehicle and the hinged wall portion 700. The foam backing insert may be configured to be received and/or anchored within a reinforced sleeve 720 (similar to reinforcing cage 200 and/or sleeve 205). When the hinged wall portion is in the open position, and the removable foam assembly and the foam backing insert have been removed, a sleeve cover (similar to 571 or 106) may be used to prevent the reinforced sleeve 720 from becoming a tripping hazard and/or the like. Various safety measures, as described above, may be used to ensure the access gate (e.g., the hinged wall portion 700 and/or any surface door associated with the access gate) does not inadvertently move between the open and closed positions.

Access to the race track surface 751 from the stands area 755 may be provided by a crossing surface 702. For example, one or more steps 701, a sloping ramp, a flat surface, and/or the like may provide a crossing surface 702 that provides pedestrian and/or vehicle access between the stands area 755 and the race track surface 751 via the hinged wall portion 700. In various embodiments, one or more surface doors (similar to 300, 600) may be used to prevent access to the crossing surface 702 from the stands area 755. When the one or more surface doors are in the closed position, they may provide a walkable or drivable surface. In various embodiments, an end gate (similar to 615) may also be provided (e.g., when the access gate is in the open position). The end gate may prevent access to the crossing surface 702 from the wrong end and/or may guide pedestrians to the correct entry point to the crossing surface 702.

Method for Providing Access Across a Wall

FIG. 18 is a flowchart illustrating various process and operations that may be completed in accordance with various embodiments of the present invention. Particularly, FIG. 18 provides an example method for providing access across a wall and/or fence, wherein the wall acts as a protective barrier and the wall separates two areas of different elevation.

At step 802, at least one surface door (e.g., 300, 600) is moved or rotated from a closed and/or horizontal or approximately horizontal position to an open and/or vertical or approximately vertical position. In various embodiments, at least one locking mechanism may lock the at least one surface door (e.g., 300, 600) in the closed and/or approximately horizontal position. In such embodiments, the locking mechanism may need to be unlocked before the at least one surface (e.g., 300, 600) can be rotated from the closed and/or horizontal or approximately horizontal position into the open and/or vertical or approximately vertical position. The at least one surface door (e.g., 300, 600) is then secured into the open and/or vertical or approximately vertical position possibly via a locking block 320, locking pin 315, and/or the like.

At step 804, any door supports and/or barrier supports (e.g., 150, 104, 105, 570, 504, 505) may be removed. For example, door support 150 may be removed. Also, barrier supports configured to secure the hinged wall portion (e.g., 400, 500, 700) when the hinged wall portion is in the closed position may be removed. For example, the removable foam assembly 104, foam backing insert 105, one or more gate pins (e.g., 420, 520, 720), strap support system 570, and/or the like may be removed. As noted above, one gate pin (e.g., 421, 521, 721) may be left in place to act as the hinge pin for the hinged wall portion (e.g., 400, 500). Sleeve and hole covers (e.g., 106, 571) may be placed in appropriate positions to prevent pedestrians from tripping over or falling into holes and open sleeves in the ramp 102 or crossing surface (e.g., 502).

At step 806, a winch (e.g., 405, 535) may be operated (e.g., driven, cranked, and/or the like) to rotate and/or move the hinged wall portion (e.g., 400, 500, 700) into the open position. In one embodiment, the winch may be operated with approximately five foot-pounds of torque or more to rotate the hinged wall portion (e.g., 400, 500, 700) into the open position.

At step 808, once the hinged wall portion (e.g., 400, 500, 700) is in the open position, the hinged wall portion may be secured (e.g., via gate cable 414). A handrail may be positioned at step 810. For example, a handrail 160 may be placed along the length of the ramp 102 such that the support legs of the handrail rest on the surface of the ramp or are received by corresponding holes 152 in the surface of the ramp.

At step 812, a foldable mesh portion 140 of the catch fence 120 may be secured into the open and/or folded position. In some embodiments, removable cable supports 145 may be removed and/or moved into an open position to allow additional headroom for pedestrians (e.g., spectators, individuals, and/or the like) passing through the pedestrian access gate. For example, the removable cable supports 145 may be unshackled and laid aside before the foldable mesh portion 140 of the catch fence 120 is secured in to the open and/or folded position.

In various embodiments, methods for providing access across a wall and/or fence may include conducting the steps illustrated in FIG. 18 in a different order than shown. For example, in one embodiment, step 812 may be performed before step 804. Some embodiments may include additional steps not illustrated in FIG. 18 or may omit steps illustrated in FIG. 18 as appropriate for the application.

In various applications, it may be advantageous to prevent pedestrian access at various points in time (e.g., during a race, a time trial, track maintenance, and/or the like). To prevent access to crossing the wall, an opposite method may be employed. For example, the removable cable supports 145 and foldable mesh portion 140 of the catch fence 120 may be secured into corresponding closed and/or protective positions such that the foldable mesh portion and the removable cable supports act to prevent debris from crossing from the race track 1 into the stands area 5. The handrail 160 and the gate cable (e.g., 414) may be removed and the winch (e.g., 405, 535) may be operated to rotate the hinged wall portion (e.g., 400, 500, 700) into a closed position. Sleeve and hole covers (e.g., 106, 571) may be removed and barrier supports (e.g., hinge pins 420,520, foam assembly 104, foam backing insert 105, strap support system 570, and/or the like) may be secured into their appropriate positions. Any door support (e.g., 150) may also be placed into the appropriate position. One or more surface doors (e.g., 300, 600) may be rotated and/or moved into a closed and/or horizontal or approximately horizontal position. In some embodiments, the surface door(s) (e.g., 300, 600) may be secured into the closed and/or horizontal or approximately horizontal position.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A barrier system comprising:

a wall; and at least one access gate for allowing pedestrian and/or vehicle access to cross the wall, the access gate comprising:

at least one hinged wall portion moveable between an open position and a closed position, wherein, when said hinged wall portion is in the closed position, said hinged wall portion is configured to act as a barrier between a first side of the wall and a second side of the wall, said second side of the wall elevated with respect to said first side of the wall, and, when said hinged wall portion is in the open position, said hinged wall portion is configured to allow passage between the first side of the wall and the second side of the wall;

a crossing surface configured to allow pedestrian passage between the first side of the wall and the second side of the wall, the hinged wall portion located at a first end of said crossing surface;

at least one hinged surface door moveable between a closed position and an open position, wherein, when said hinged surface door is in the closed position, the hinged surface door is configured to prevent access to said crossing surface and to provide a walkable and/or drivable surface above said crossing surface and, when said hinged surface door is in the open position, the hinged surface door is configured to provide access to a second end of said crossing surface, wherein, when said hinged surface door is in the closed position, a first edge of said hinged surface door is substantially aligned with the second side of the wall and an opposite edge of said hinged surface door is substantially aligned with the second end of said crossing surface; and a permanent catch fence located above said at least one hinged wall portion;

a foldable catch fence located below said permanent catch fence and above at least a portion of said at least one hinged wall portion, the foldable catch fence configured to be folded into a retracted, elevated position to provide additional head room when the hinged wall portion is the in the open position, and the foldable catch fence configured to be secured into an unfolded position when the hinged wall portion is in the closed position to act as a barrier between the first side and the second side of the wall, wherein when the foldable catch fence is in the unfolded position and the hinged surface door is in the closed position, a portion of the foldable catch fence is substantially aligned with the first edge of the hinged surface door.

2. The barrier system of claim 1 wherein the at least one hinged wall portion is configured to be moved between the open position and the closed position by a winch.

3. The barrier system of claim 1 wherein at least one pneumatic piston is connected to said at least one hinged surface door, wherein the at least one pneumatic piston is configured to assist movement of said hinged surface door between the closed and open positions.

4. The barrier system of claim 1 further comprising at least one lock block configured to be positioned below a lower edge of said at least one hinged surface door when said hinged surface door is in the open position and configured to prevent said hinged surface door from moving to the closed position.

5. The barrier system of claim 1 further comprising at least one door support configured to be positioned between said crossing surface and said at least one hinged surface door when said hinged surface door is in the closed position and configured to support said hinged surface door in a horizontal position to provide the walkable and/or drivable surface.

6. The barrier system of claim 1 wherein the wall comprises at least one normal wall portion, at least one hinge panel, at least one latch panel, and said at least one hinged wall portion, said hinged wall portion hingedly connected to said hinge panel and said hinged wall portion configured to rest against at least a portion of said latch panel when said hinged wall portion is in the closed position.

7. The barrier system of claim 6 further comprising at least one hinge pin and at least one latch pin, said at least one hinge pin configured to pass through at least a portion of said hinged wall portion and said hinge panel and said at least one latch pin configured to pass through at least a portion of said hinged wall portion and said latch panel when said hinged wall portion is in the closed position.

8. The barrier system of claim 7, wherein the at least one hinge pin and the at least one latch pin extend into corresponding pin holes in said crossing surface.

9. The barrier system of claim 7, wherein the at least one hinge pin acts as the pin in a hinge when the hinged wall portion is moved between the open and closed positions.

10. The barrier system of claim 1 further comprising at least one of a locking hook and a gate cable, said locking hook and said gate cable configured, when engaged when the hinged wall portion is in the open position, to prevent the hinged wall portion from moving between the open position and the closed position.

11. The barrier system of claim 1, wherein said at least one hinged surface door comprises two hinged surface doors, at least a first one of said two hinged surface doors comprising an overlap portion and, when said two hinged surface doors are in the closed position, said overlap portion of said first hinged surface door being configured to overlap a portion of said second hinged surface door.

12. The barrier system of claim 1, wherein said at least one hinged surface door comprises two hinged surface doors, said access gate further comprising at least one door support configured to be positioned between said crossing surface and said two hinged surface doors when said hinged surface doors are in the closed position and wherein at least a portion of each of said two hinged surface doors rests on the at least one door support.

13. The barrier system of claim 1 wherein the wall is around a race track and configured to act as a barrier between pedestrians watching a race and the race track.

14. The barrier system of claim 13 further comprising a handrail, the handrail having at least one support post configured to rest in at least one support post hole located in said crossing surface when said hinged surface door is in the open position.

* * * * *